US011400001B2

(12) United States Patent
Ribble et al.

(10) Patent No.: US 11,400,001 B2
(45) Date of Patent: Aug. 2, 2022

(54) METHOD AND APPARATUS FOR UPGRADING A BED TO INCLUDE MOVEABLE COMPONENTS

(71) Applicant: Hill-Rom Services, Inc., Batesville, IN (US)

(72) Inventors: David L. Ribble, Batesville, IN (US); Craig M. Meyerson, Syracuse, NY (US); Lori Zapfe, Milroy, IN (US); John V. Harmeyer, Cleves, OH (US); Xuan Teng, Batesville, IN (US); Jotpreet Chahal, Fayetteville, NY (US); Thomas F. Heil, Batesville, IN (US); Kirsten M. Emmons, Batesville, IN (US); David L. Bedel, Oldenburg, IN (US); Kenneth L. Lilly, West Chester, OH (US); Nicholas Mann, Batesville, IN (US); Andrew Robert Taylor, Cambridge (GB); Alistair Andrew James Ward, Cambridge (GB); Martyn Thomas Mitchell, Royston (GB); Ibne Soreefan, West Chester, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 166 days.

(21) Appl. No.: 16/583,359

(22) Filed: Sep. 26, 2019

(65) Prior Publication Data

US 2020/0100969 A1 Apr. 2, 2020

Related U.S. Application Data

(60) Provisional application No. 62/841,487, filed on May 1, 2019, provisional application No. 62/739,343, filed on Oct. 1, 2018.

(51) Int. Cl.

| | |
|---|---|
| ***A61G 7/10*** | (2006.01) |
| ***A61G 7/05*** | (2006.01) |
| ***A61G 7/002*** | (2006.01) |

(52) U.S. Cl.

CPC ..... *A61G 7/1021* (2013.01); *A61G 7/002* (2013.01); *A61G 7/0508* (2016.11)

(58) Field of Classification Search

CPC ..... A61G 7/002; A61G 7/0508; A61G 7/1021

See application file for complete search history.

(56) References Cited

U.S. PATENT DOCUMENTS

| | | | |
|---|---|---|---|
| 948,644 | A | 2/1910 | Bjornstad |
| 1,610,898 | A | 12/1926 | Steiner |

(Continued)

FOREIGN PATENT DOCUMENTS

| | | | |
|---|---|---|---|
| DE | 1987293 | A1 | 6/1968 |
| JP | S5438512 | U | 3/1979 |

(Continued)

OTHER PUBLICATIONS

"Connect." Merriam-Webster, Merriam-Webster, www.merriam-webster.com/dictionary/connect.*

(Continued)

*Primary Examiner* — David R Hare
*Assistant Examiner* — Madison Emanski
(74) *Attorney, Agent, or Firm* — Barnes & Thornburg LLP

(57) ABSTRACT

A mattress support includes a first section and a second section configured to be coupled to the first section. Each of the first section and the second section includes a base plate configured to be positioned on a box frame of a bed. A top plate is pivotable relative to the base plate. A bladder structure is positioned between the base plate and the top plate and inflatable to adjust a height of the top plate.

23 Claims, 28 Drawing Sheets

(56) References Cited

U.S. PATENT DOCUMENTS

| | | | |
|---|---|---|---|
| 2,612,645 | A | 10/1952 | Boland |
| 2,887,692 | A | 5/1959 | Gosman |
| 3,392,412 | A | 7/1968 | Aymar |
| 3,426,373 | A | 2/1969 | Scott et al. |
| 3,606,623 | A | 9/1971 | Aymar et al. |
| 3,667,075 | A | 6/1972 | Ballard |
| 3,781,928 | A | 1/1974 | Swallert |
| 4,142,263 | A | 3/1979 | Pierson |
| 4,150,284 | A | 4/1979 | Trenkler et al. |
| 4,151,407 | A | 4/1979 | Delagi et al. |
| 4,165,125 | A | 8/1979 | Owen |
| 4,183,015 | A | 1/1980 | Drew et al. |
| 4,216,462 | A | 8/1980 | Digiacomo et al. |
| 4,225,953 | A | 9/1980 | Simon et al. |
| 4,228,426 | A | 10/1980 | Roberts |
| 4,237,344 | A | 12/1980 | Moore |
| 4,298,863 | A | 11/1981 | Natitus et al. |
| 4,309,783 | A | 1/1982 | Cammack et al. |
| 4,331,953 | A | 5/1982 | Blevins et al. |
| 4,527,298 | A | 7/1985 | Moulton |
| 4,542,547 | A | 9/1985 | Sato |
| 4,554,693 | A | 11/1985 | Calloway |
| 4,577,185 | A | 3/1986 | Andersen |
| 4,578,671 | A | 3/1986 | Flowers |
| 4,593,273 | A | 6/1986 | Narcisse |
| 4,598,275 | A | 7/1986 | Ross et al. |
| 4,601,064 | A | 7/1986 | Shipley |
| 4,649,385 | A | 3/1987 | Aires et al. |
| 4,680,790 | A | 7/1987 | Packard et al. |
| 4,814,751 | A | 3/1989 | Hawkins et al. |
| 4,839,932 | A | 6/1989 | Williamson |
| 4,850,040 | A | 7/1989 | Teich et al. |
| 4,877,288 | A | 10/1989 | Lee |
| 4,932,089 | A | 6/1990 | Laviero |
| 4,955,000 | A | 9/1990 | Nastrom |
| 4,967,195 | A | 10/1990 | Shipley |
| 4,990,892 | A | 2/1991 | Guest et al. |
| 4,998,095 | A | 3/1991 | Shields |
| 4,998,939 | A | 3/1991 | Potthast et al. |
| 5,012,539 | A | 5/1991 | Grigg |
| 5,036,852 | A | 8/1991 | Leishman |
| 5,060,174 | A | 10/1991 | Gross |
| 5,062,151 | A | 10/1991 | Shipley |
| 5,065,154 | A | 11/1991 | Kaiser et al. |
| 5,086,290 | A | 2/1992 | Murray et al. |
| 5,103,108 | A | 4/1992 | Crimmins |
| 5,124,991 | A | 6/1992 | Allen |
| 5,137,033 | A | 8/1992 | Norton |
| 5,144,284 | A | 9/1992 | Hammett |
| 5,153,584 | A | 10/1992 | Engira |
| 5,170,522 | A | 12/1992 | Walker |
| 5,184,112 | A | 2/1993 | Gusakov |
| 5,195,198 | A | 3/1993 | Travis |
| 5,253,656 | A | 10/1993 | Rincoe et al. |
| 5,269,388 | A | 12/1993 | Reichow et al. |
| 5,276,432 | A | 1/1994 | Travis |
| 5,311,625 | A | 5/1994 | Barker et al. |
| 5,345,630 | A | 9/1994 | Healy |
| 5,353,012 | A | 10/1994 | Barham et al. |
| 5,415,167 | A | 5/1995 | Wilk |
| 5,432,967 | A | 7/1995 | Raftery |
| 5,490,295 | A | 2/1996 | Boyd |
| 5,528,783 | A | 6/1996 | Kunz et al. |
| 5,577,278 | A | 11/1996 | Barker et al. |
| 5,621,931 | A | 4/1997 | Hamilton |
| 5,715,548 | A | 2/1998 | Weismiller et al. |
| 5,838,223 | A | 11/1998 | Gallant et al. |
| 5,844,488 | A | 12/1998 | Musick |
| 5,867,821 | A | 2/1999 | Ballantyne et al. |
| 5,877,675 | A | 3/1999 | Rebstock et al. |
| 5,933,488 | A | 8/1999 | Marcus et al. |
| 5,936,539 | A | 8/1999 | Fuchs |
| 5,942,986 | A | 8/1999 | Shabot et al. |
| 5,944,659 | A | 8/1999 | Flach et al. |
| 5,963,137 | A | 10/1999 | Waters |
| 6,009,873 | A | 1/2000 | Neviaser |
| 6,093,146 | A | 7/2000 | Filangeri |
| 6,097,308 | A | 8/2000 | Albert et al. |
| 6,111,509 | A | 8/2000 | Holmes |
| 6,125,350 | A | 9/2000 | Dirbas |
| 6,131,219 | A | 10/2000 | Roberts |
| 6,133,837 | A | 10/2000 | Riley |
| 6,142,592 | A | 11/2000 | Grittke et al. |
| 6,183,417 | B1 | 2/2001 | Geheb et al. |
| 6,208,250 | B1 | 3/2001 | Dixon et al. |
| 6,397,416 | B2 | 6/2002 | Brooke et al. |
| 6,684,425 | B2 | 2/2004 | Davis |
| 7,154,397 | B2 | 12/2006 | Zerhusen et al. |
| 7,568,246 | B2 | 8/2009 | Weismiller et al. |
| 7,669,263 | B2 | 3/2010 | Menkedick et al. |
| 7,690,059 | B2 | 4/2010 | Lemire et al. |
| 7,852,208 | B2 | 12/2010 | Collins, Jr. et al. |
| 8,536,990 | B2 | 9/2013 | Collins, Jr. et al. |
| 8,656,541 | B2 | 2/2014 | Muollo |
| 8,789,224 | B2 | 7/2014 | Wyatt et al. |
| 2003/0041378 | A1 | 3/2003 | Davis |
| 2003/0150058 | A1 | 8/2003 | Davis |
| 2003/0196270 | A1 | 10/2003 | Leventhal et al. |
| 2006/0117482 | A1 | 6/2006 | Branson |
| 2006/0123543 | A1* | 6/2006 | DiLiberto ..... A47C 31/10 5/424 |
| 2006/0123550 | A1 | 6/2006 | Davis |
| 2006/0230539 | A1 | 10/2006 | Goodman |
| 2008/0147442 | A1 | 6/2008 | Warner et al. |
| 2012/0054965 | A1* | 3/2012 | Kummer ..... A61G 7/00 5/615 |
| 2016/0331616 | A1 | 11/2016 | Fisk et al. |
| 2018/0333082 | A1 | 11/2018 | Hoffman et al. |

FOREIGN PATENT DOCUMENTS

| | | | | |
|---|---|---|---|---|
| JP | H01238859 | A | 9/1989 | |
| JP | H04297257 | A | 10/1992 | |
| WO | WO-0057829 | A1 * | 10/2000 | ..... A61G 7/015 |
| WO | 2013134638 | A1 | 9/2013 | |
| WO | 2014117128 | A1 | 7/2014 | |

OTHER PUBLICATIONS

"Bracket." Merriam-Webster, Merriam-Webster, www.merriam-webster.com/dictionary/bracket.*

Extended European Search Report, European Application No. 19200203.8, completed Nov. 20, 2019, (7 pages).

* cited by examiner

METHOD AND APPARATUS FOR UPGRADING A BED TO INCLUDE MOVEABLE COMPONENTS

PRIORITY CLAIM

This application claims priority under 35 U.S.C. § 119(e) to U.S. Provisional Application No. 62/739,343, filed Oct. 1, 2018 and U.S. Provisional Application No. 62/841,487, filed May 1, 2019, both of which are expressly incorporated by reference herein.

TECHNICAL FIELD

The present disclosure relates to a bed assembly for use during at-home care. More specifically, the present disclosure relates to a bed assembly that elevates the head section of the traditional consumer mattress.

BACKGROUND

The present disclosure is related to a bed assembly. Specifically, the present disclosure relates to a bed assembly that is compatible with a traditional consumer bed and can enhance the traditional consumer bed so it provides features of a traditional hospital bed. Such features include the ability to elevate the head section of the traditional consumer mattress using a mattress support having inflatable air bladders.

Extended hospitalization of a patient is an ongoing challenge due to the high cost incurred by the patient and the hospital. At-home care is also challenging due to the high cost, difficulty, and complexity of equipping the home for patient care. While several systems and methods exist for equipping the home for patient care, opportunity exists for continued development in this area.

SUMMARY

The present disclosure includes one or more of the features recited in the appended claims and/or the following features which, alone or in any combination, may comprise patentable subject matter.

According to a first aspect of the present disclosure, a mattress support includes a first section and a second section configured to be coupled to the first section. Each of the first section and the second section include a base plate configured to be positioned on a box frame of a bed. A top plate is hingedly attached to the base plate. A bladder is positioned between the base plate and the top plate and inflatable to pivot the top plate. The base plate of each of the first section and the second section includes a plurality of posts and a plurality of apertures. The posts of the first section are insertable into the apertures of the second section, and the posts of the second section are insertable into the apertures of the first section to couple the first section to the second section.

In some embodiments, the bladder of the first section may be fluidly coupled to a first pump, and the bladder of the second section may be fluidly coupled to a second pump. The bladder of the first section may be fluidly coupled to the bladder of the second section. The bladder of the first section may be fluidly coupled to a pump.

In some embodiments, a third section may have a base that couples to the base of the second section. A plurality of sections may be configured to be coupled to one another. The plurality of sections may be sized to be coupled together to accommodate a width of a mattress.

In some embodiments, the top plate of each of the first section and the second section may include a plurality of apertures configured to receive a rod to couple the top plate of the first section to the top plate of the second section.

In some embodiments, the top plate and the bladder may nest within the base plate. The base plate and the bladder may nest within the top plate.

In some embodiments, a siderail may be coupled to at least one of the first section and the second section. The base plate may include a bore configured to receive the siderail. The bladder may include a bore configured to receive the siderail. The siderail may include an extendable arm. The extendable arm may be a telescoping arm.

According to a second aspect of the present disclosure, a mattress support includes a first section and a second section configured to be coupled to the first section. Each of the first section and the second section includes a base plate configured to be positioned on a box frame of a bed. A top plate is hingedly attached to the base plate. A bladder is positioned between the base plate and the top plate and inflatable to adjust a height of the top plate. The bladder of the first section is fluidly coupled to the bladder of the second section. A pump is fluidly coupled to the bladder of the first section to inflate the bladder of both the first section and the second section.

In some embodiments, a third section may have a bladder that couples to the bladder of the second section.

In some embodiments, the first section, second section, and third section may be sized to be coupled together to accommodate a width of a mattress.

In some embodiments, the top plate and the bladder nest within the base plate. The base plate and the bladder may nest within the top plate.

In some embodiments, a siderail may be coupled to at least one of the first section and the second section. The base plate may include a bore configured to receive the siderail. The bladder may include a bore configured to receive the siderail. The siderail may include an extendable arm. The extendable arm may be a telescoping arm.

According to a third aspect of the present disclosure, a system for positioning a mattress support between a mattress and a box frame includes a first sleeve coupled to a head end of the mattress. A second sleeve is coupled to a foot end of the mattress. A cable extends between the first sleeve and the second sleeve. The cable is configured to be actuated such that tension is provided between the first sleeve and the second sleeve to lift the head end and the foot end of the mattress from the box frame.

In some embodiments, an anchor may be positioned on the mattress. The cable may extend between the first sleeve and the second sleeve over the anchor. The first sleeve may be positioned around the head end of the mattress. The second sleeve may be positioned around the foot end of the mattress.

In some embodiments, a first end of the cable may be secured to the first sleeve, and the second end of the cable may extend through an eyelet in the second sleeve. The cable may be configured to be pulled by the second end through the eyelet of the second sleeve. A first end of the cable may be secured to the second sleeve, and the second end of the cable may extend through an eyelet in the first sleeve. The cable may be configured to be pulled by the second end through the eyelet of the first sleeve. A winch may be provided to pull the cable. The cable may be configured to lift the head end of the mattress so that a mattress support is positionable between the head end of the mattress and the box frame.

According to a fourth aspect of the present disclosure, a system for positioning a mattress support between the head end of a mattress and a box frame includes a cable secured to a rod. The rod is configured to be advanced under the head end of the mattress between the head end of the mattress and the box frame. A first mattress support is positioned on a left side of the mattress and coupled to a first end of the cable. A second mattress support is positioned on a right side of the mattress and coupled to a second end of the cable. The cable is pulled to advance the first mattress support and the second mattress support under the head end of the mattress.

In some embodiments, the first mattress support and the second mattress support include angled sides that slide between the head end of the mattress and the box frame.

According to a fifth aspect of the present disclosure, a mattress support system comprises a head end group. The head end group includes a first module and a second module configured to be coupled to the first module. Each of the first module and the second module is configured to be positioned under a mattress. Each of the first module and second module includes a lower plate, an upper plate, and a bladder structure. The lower plate is configured to be positioned on frame of a bed. The upper plate is hingedly attached to the base plate at a hinge point. The bladder structure is positioned between the base plate and the top plate and inflatable to pivot the top plate about the hinge point. The lower plate of each of the first module and the second module includes connectors to engage on a first side of the respective module and complementary connectors on a second side of the respective modules. The connectors on the first side of the first module and the complementary connectors on the second side of the second module interengaged to maintain the position of the second module relative to the first module. A hose interconnects the bladder structures of each of the first and second modules to provide open communication of fluid between the bladder structures.

In some embodiments, the mattress support system further comprises a fluid pump to provide fluid to the bladders structures to inflate the bladder structures and pivot the upper plates about the respective hinge points.

In some embodiments, the bladder structures include respective upper bladders and respective lower bladders, the upper bladder and lower bladder of each bladder structure being pneumatically communicative.

In some embodiments, the upper plates of each of the first and second modules are connected to move together about their respective hinge points.

In some embodiments, the support structure includes at least one mattress locator secured to one of the first and second modules.

In some embodiments, the mattress locator is secured by a ratchet lock. In some embodiments, the mattress locator includes a pair of locking sections. In some embodiments, the locking sections includes ratchet teeth. In some embodiments, the mattress support system further includes a ratchet lock with ratchet teeth engaged with the ratchet teeth of the locking section of the siderail support to secure the first and second modules together. In some embodiments, the ratchet lock includes two wings, each of the arms including the ratchet teeth, the wings moveable to engage and disengage with the teeth of the locking sections of the locking sections of the siderail supports.

In some embodiments, the support structure includes at least one siderail support secured to one of the first and second modules. In some embodiments, the siderail support includes a structure that functions as a mattress locator. In some embodiments, the siderail support includes receivers for receiving legs of a siderail. In some embodiments, the siderail support includes a pair of locking sections. In some embodiments, the locking sections includes ratchet teeth. In some embodiments, the mattress support system further includes a ratchet lock with ratchet teeth engaged with the ratchet teeth of the locking section of the siderail support to secure the first and second modules together. In some embodiments, the ratchet lock includes two wings, each of the arms including the ratchet teeth, the wings moveable to engage and disengage with the teeth of the locking sections of the locking sections of the siderail supports.

In some embodiments, the support structure includes at least one connector securing the first and second modules. In some embodiments, the connector includes a pair of locking sections. In some embodiments, the locking sections include ratchet teeth. In some embodiments, the mattress support system further includes a ratchet lock with ratchet teeth engaged with the ratchet teeth of the locking section of the connector to secure the first and second modules together. In some embodiments, the ratchet lock includes two wings, each of the arms including the ratchet teeth, the wings moveable to engage and disengage with the teeth of the locking sections of the locking sections of the connector.

In some embodiments, the mattress support system further includes a foot end group including a third module and a fourth module configured to be coupled to the third module. Each of the third module and the fourth module are configured to be positioned under a mattress. Each of the third module and fourth module includes a lower plate, an upper plate, and a bladder structure. The lower plate is configured to be positioned on frame of a bed. The upper plate is hingedly attached to the base plate at a hinge point. The bladder structure is positioned between the base plate and the top plate and inflatable to pivot the top plate about the hinge point. The lower plate of each of the third module and the fourth module includes connectors to engage on a first side of the respective module and complementary connectors on a second side of the respective modules. The connectors on the first side of the third module and the complementary connectors on the second side of the fourth module are interengaged to maintain the position of the fourth module relative to the third module. A hose interconnects the bladder structures of each of the third and fourth modules to provide open communication of fluid between the bladder structures.

In some embodiments, the head end group and the foot end group are interconnected by at least one tether to prevent head end group and the foot end group from being pushed away from one another by the pressure of a mattress.

In some embodiments, the support structure includes at least one connector securing the third and fourth modules. In some embodiments, the connector includes a pair of locking sections. In some embodiments, the locking sections include ratchet teeth.

In some embodiments, the mattress support system further includes a ratchet lock with ratchet teeth engaged with the ratchet teeth of the locking section of the connector to secure the third and fourth modules together. In some embodiments, the ratchet lock includes two wings, each of the arms including the ratchet teeth, the wings moveable to engage and disengage with the teeth of the locking sections of the locking sections of the connector.

According to a sixth aspect of the present disclosure, a mattress support system comprises a first group including a first module and a second module configured to be coupled to the first module, at least one coupler extension, and at least one hose. Each of the first module and the second module are configured to be positioned under a mattress. Each of the first module and second module include a lower plate an upper plate and a bladder structure. The lower plate is configured to be positioned on frame of a bed. The upper plate is supported on the lower plate to permit the upper plate to pivot relative to the lower plate at a pivot point. The bladder structure is positioned between the base plate and the top plate and inflatable to pivot the top plate about the pivot point. The upper plate of each of the first module and the second module includes brackets positioned on an upper surface of the respective upper plate. The at least one coupler extension is positionable in at least one bracket of a first module and in at least one bracket of second module to interengage the two modules. The hose interconnects the bladder structures of each of the first and second modules to provide open communication of fluid between the bladder structures.

In some embodiments, the mattress support system further comprises a fluid pump to provide fluid to the bladders structures to inflate the bladder structures and pivot the upper plates about the respective pivot points.

In some embodiments, the bladder structures include respective upper bladders and respective lower bladders, the upper bladder and lower bladder of each bladder structure being pneumatically communicative.

In some embodiments, interengagement of the modules by the at least one coupler extensions causes the upper plates of each of the first and second modules to move together about their respective pivot points.

In some embodiments, the coupler extension includes a plurality of apertures. The apertures may positioned to receive pins that are supported on the coupler extension and configured to engage a bracket to prevent movement of the coupler extension relative to the bracket when the coupler extension is positioned in the bracket.

In some embodiments, the mattress support system includes at least one mattress locator secured to one of the first and second modules.

In some embodiments, the mattress locator is secured by a bracket on an upper surface of an upper plate of at least one of the first or second module.

In some embodiments, the support system includes at least one siderail support secured to one of the first and second modules. The siderail support may a structure that secures first and second modules together. The siderail support may include receivers for receiving legs of a siderail.

In some embodiments, the lower plate includes a bracket and when the bladders structure is inflated, a lower edge of the upper plate engages the bracket to define the pivot point about which the upper plate pivots, the bracket restraining movement of the upper plate relative to the lower plate.

Additional features, which alone or in combination with any other feature(s), such as those listed above and/or those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION

Figure 1:
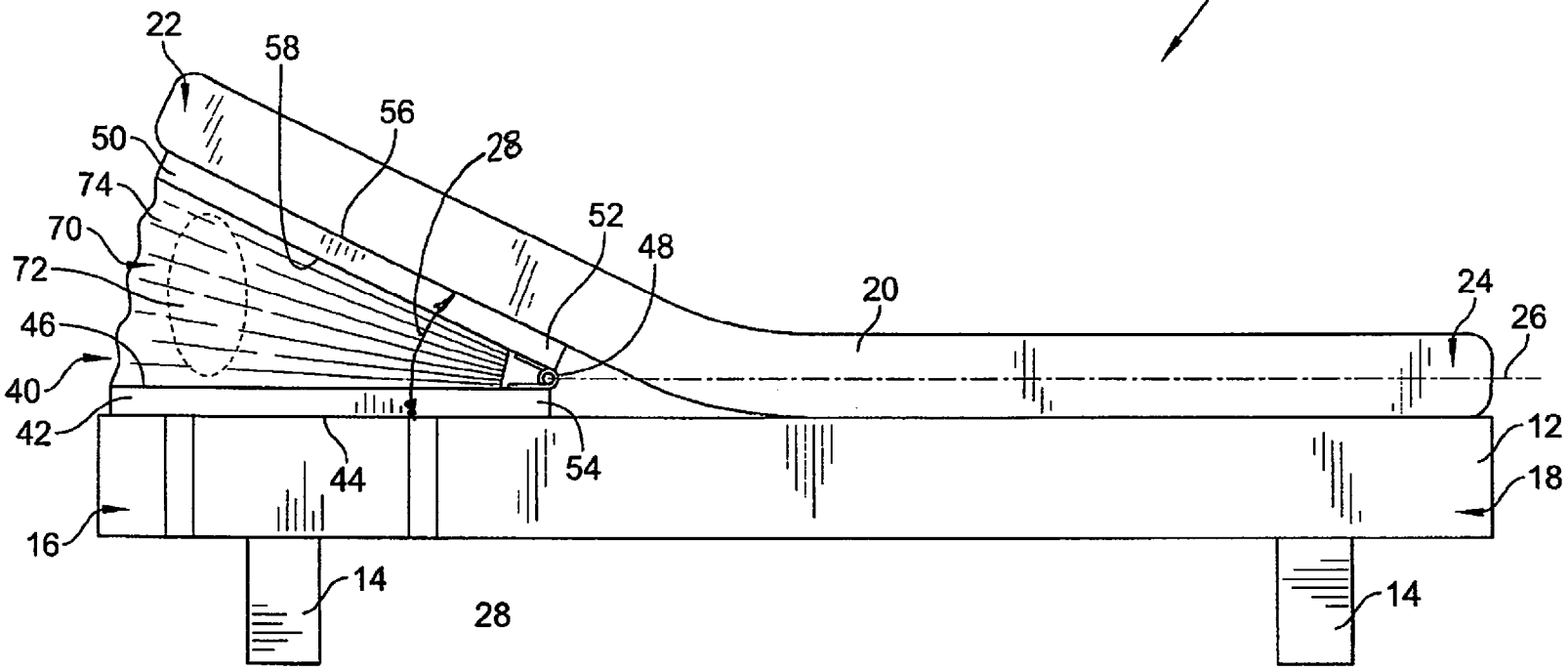
FIG. 1 is a side elevation view of a bed having a mattress support positioned between a mattress and a bed frame.

An illustrative bed assembly 10 is shown in FIG. 1. The bed assembly 10 includes a frame 12 or box spring that is supported on the floor with legs 14. The frame 12 includes a head end 16 and a foot end 18. A mattress 20 is positioned on the frame 12 and extends between the head end 16 and the foot end 18 of the frame 12. A head end 22 of the mattress 20 is positioned at the head end 16 of the frame 12, and a foot end 24 of the mattress 20 is positioned at the foot end 18 of the frame 12. At least one of the head end 22 and the foot end 24 of the mattress 20 is moveable to angle relative to a longitudinal axis 26 of the frame 12. That is, the head end 22 and the foot end 24 of the mattress 20 may be raised relative to the frame 12. FIG. 1 illustrates the head end 22 in a raised position at an angle 28 relative to the longitudinal axis 26 of the frame 12.

A mattress support 40 is positioned between the head end 16 of the frame 12 and the head end 22 of the mattress 20 to raise the head end 22 of the mattress 20. The mattress support 40 includes a base plate 42 having a bottom surface 44 and a top surface 46. The bottom surface 44 of the base plate 42 is positioned in contact with the frame 12. The top surface 46 of the base plate 42 faces upward from the frame 12. A top plate 50 is coupled to the base plate 42. An end 52 of the top plate 50 is coupled to an end 54 of the base plate 42 via a hinge 48 so that the top plate 50 is rotatable relative to the base plate 42 about the ends 52 and 54. The top plate 50 includes a top surface 56 and a bottom surface 58. The head end 22 of the mattress 20 is positioned on the top surface 56 of the top plate 50. The bottom surface 58 of the top plate 50 faces downward from the mattress 20.

An elevation assembly 70 is positioned between the base plate 42 and the top plate 50. The elevation assembly 70 is coupled to the bottom surface 58 of the top plate 50 and the top surface 46 of the base plate 42. In the illustrative embodiment, the elevation assembly 70 includes an air bladder 72 positioned within an expandable envelope 74. In some embodiments, the elevation assembly 70 may include a plurality of air bladders 72 positioned within an expandable envelope 74. The air bladder 72 is inflatable to angle the top plate 50 relative to the base plate 42, thereby raising the head end 22 of the mattress 20.

Figure 2:
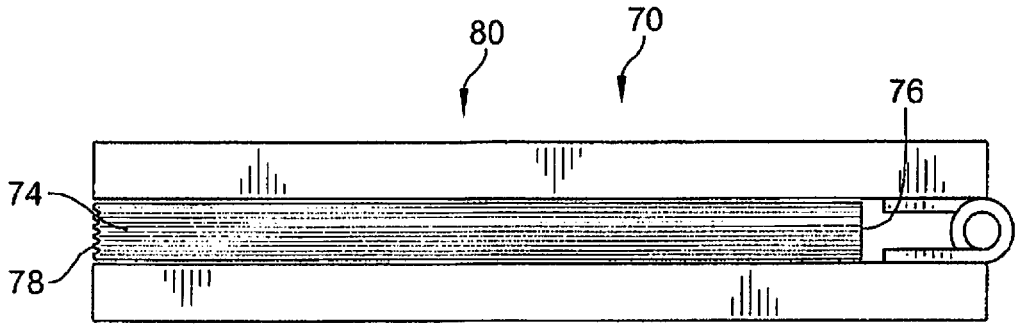
FIG. 2 is a side elevation view of the mattress support in a lowered position.
Figure 3:
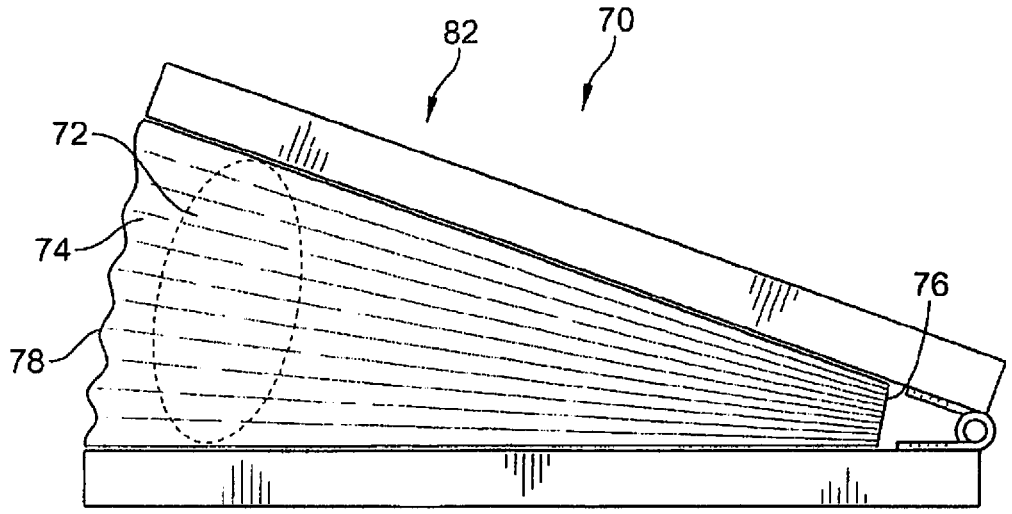
FIG. 3 is a side elevation view of the mattress support in a raised position.

Referring to FIGS. 2 and 3, the envelope 74 includes a fixed end 76 at the ends 52 and 54 of the top plate 50 and the base plate 42, respectively. The envelope 74 also includes an expandable end 78 that is configured as an accordion sleeve that expands and contracts. In some embodiments, the structure of the elevation assembly 70 may be embodied similarly to the z-plate assemblies 2044 and 2064 shown in PCT Publication No. WO2016/196403, titled "Patient Support Apparatus." Similarly, the bladder 72 may be embodied similarly to the turn bladder assemblies 2034 and 2036 shown in the PCT Publication No. WO2016/196403, titled "Patient Support Apparatus." The PCT Publication No. WO2016/196403, titled "Patient Support Apparatus" is incorporated by reference herein for the disclosure of a structure suitable to lift portions of a mattress.

The elevation assembly 70 raises and lowers the mattress support 40 between a lowered position 80, shown in FIG. 2, and a raised position 82, shown in FIG. 3. Notably, the mattress support 40 may be raised or lowered to any intermediate position between the lowered position 80 and the raised position 82.

Figure 4:
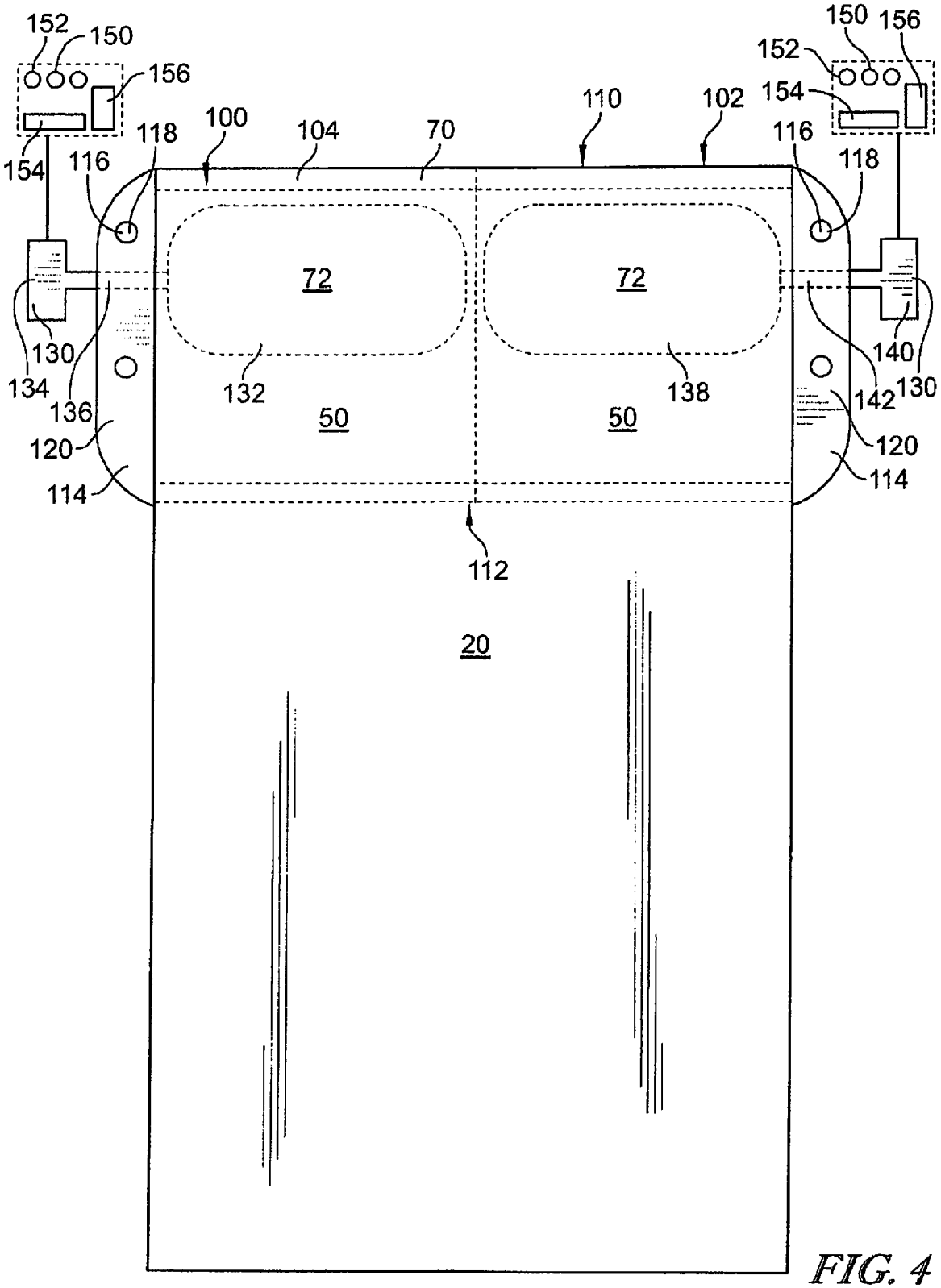
FIG. 4 is a top plan view of an embodiment of a mattress support positioned under a mattress.

Referring to FIG. 4, the elevation assembly 70 is shown in broken lines below the mattress 20. The elevation assembly 70 includes a left half 100 and a right half 102 that are coupled together under the mattress 20 (as described in more detail below). Each of the left half 100 and the right half 102 includes a frame 104. The frame 104 of the left half 100 couples to the frame of the right half 102 to form the frame 104 around the top plate 50 and the base plate 42 (not shown in FIG. 4). The frame 104 includes a head end 110 and a foot end 112 coupled by sides 114. The sides 114 extend out from beneath the mattress 20. In the illustrative embodiments, the sides 114 include apertures 116 extending from openings 118 in a top surface 120 of each side 114. The apertures 116 are configured to receive the posts of a left and right siderail, respectively (as described in more detail below).

The bladder 72 of the each of the left half 100 and right half 102 is illustrated in broken lines. Each half 100, 102 includes its own bladder 72. Each bladder 72 is coupled to a pump 130 to inflate and deflate the respective bladder 72. That is, a left bladder 132 is coupled to a left pump 134 by a hose 136, and a right bladder 138 is coupled to a right pump 140 by a hose 142. Each pump 134 and 140 is independently operable so that the left bladder 132 and the right bladder 138 are independently inflated and deflated. The left bladder 132 and the right bladder 138 may be inflated/deflated to different pressures. Alternatively, the left bladder 132 and the right bladder 138 are inflated to the same pressure so that the left half 100 and the right half 102 are raised to the same height. An optional control panel 150 may be utilized to inflate/deflate the bladders 132, 138. The control panel 150 may include controls 152 to independently operate the left bladder 132 and the right bladder 138. The control panel 150 may be retroactively secured to the bed frame 12. Optionally, the control panel 150 may be positioned next to the bed 10 such that the control panel 150 is within reach of the bed 10. Alternatively or additionally, the control panel 150 may be incorporated into a patient pendant that is within reach of the bed 10. In some embodiments, the controls 152 operate the left bladder 132 and the right bladder 138 in unison. The control panel 150 may include a meter 154 that measures the pressure in each of the left bladder 132 and the right bladder 138. The pressure and/or a height of the left half 100 and the right half 102 may be displayed on a display 156 of the control panel 150. In yet another embodiment, the controls 152, meter 154, and display 156 are incorporated into the pumps 134, 140.

Figure 5:
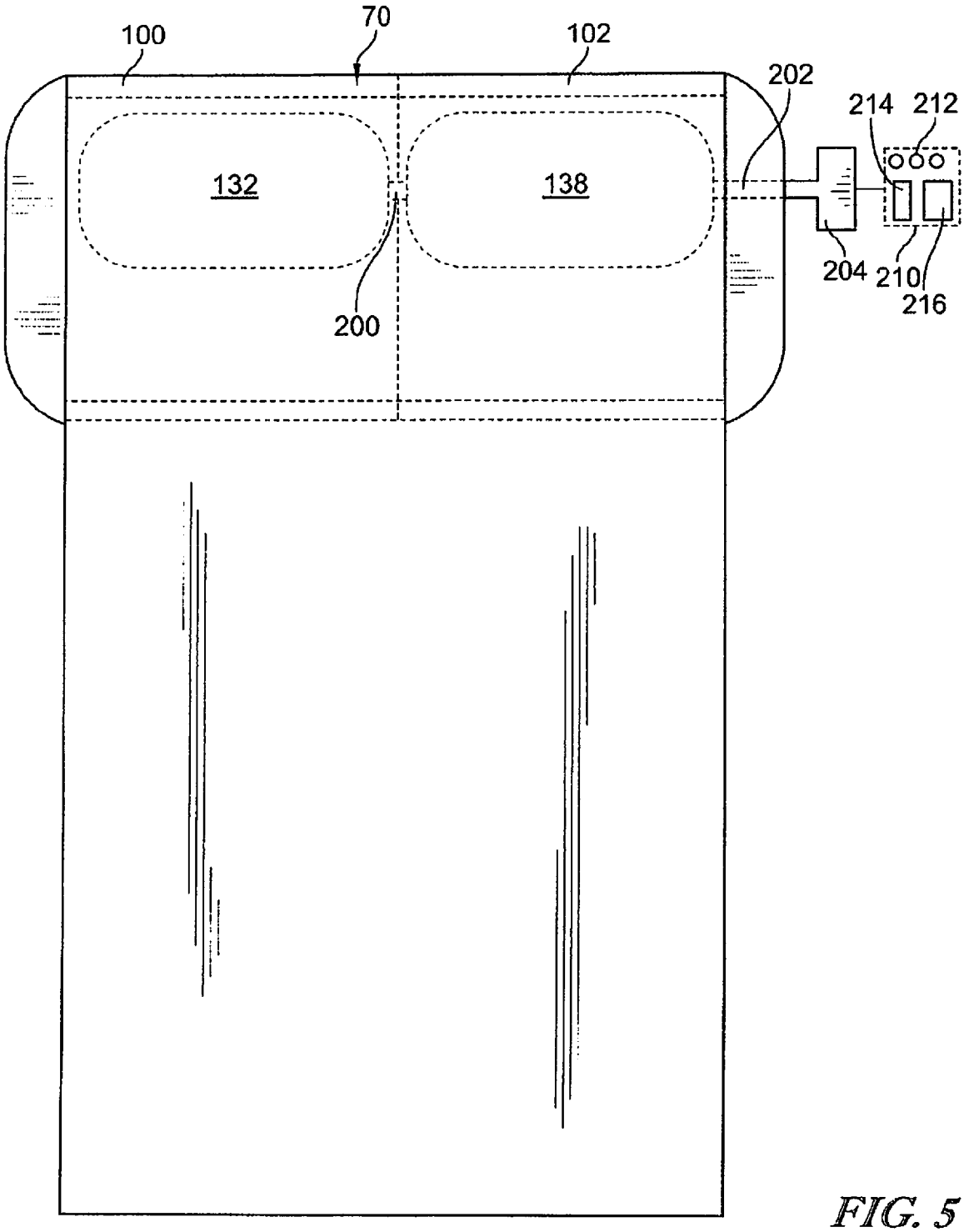
FIG. 5 is a top plan view of another embodiment of a mattress support positioned under a mattress.

Referring to FIG. 5, another embodiment of the elevation assembly 70 is provided. Each of the left half 100 and the right half 102 includes the respective left bladder 132 and the right bladder 138. The left bladder 132 and the right bladder 138 are fluidly coupled by a hose 200. A hose 202 fluidly couples the right bladder 138 to a pump 204. In another embodiment, the hose 202 couples the left bladder 132 to the pump 204. The pump 204 is operable to inflate and deflate both the left bladder 132 and the right bladder 138 in unison. That is, air flows from the pump 204 into the right bladder 138 through the hose 202. The air then flows from the right bladder 138 into the left bladder 132 through the hose 200, so that the left bladder 132 and the right bladder 138 are simultaneously filled with air. An optional control panel 210 may include controls 212 to operate the left bladder 132 and the right bladder 138. The control panel 210 may be retroactively secured to the bed frame 12. Optionally, the control panel 210 may be positioned next to the bed 10 such that the control panel 210 is within reach of the bed 10. Alternatively or additionally, the control panel 210 may be incorporated into a patient pendant that is within reach of the bed 10. The control panel 210 may include a meter 214 that measures the pressure in each of the left bladder 132 and the right bladder 138. The pressure and/or a height of the left half 100 and the right half 102 may be displayed on a display 216 of the control panel 210. In yet another embodiment, the controls 212, meter 214, and display 216 are incorporated into the pump 204.

Figure 6:
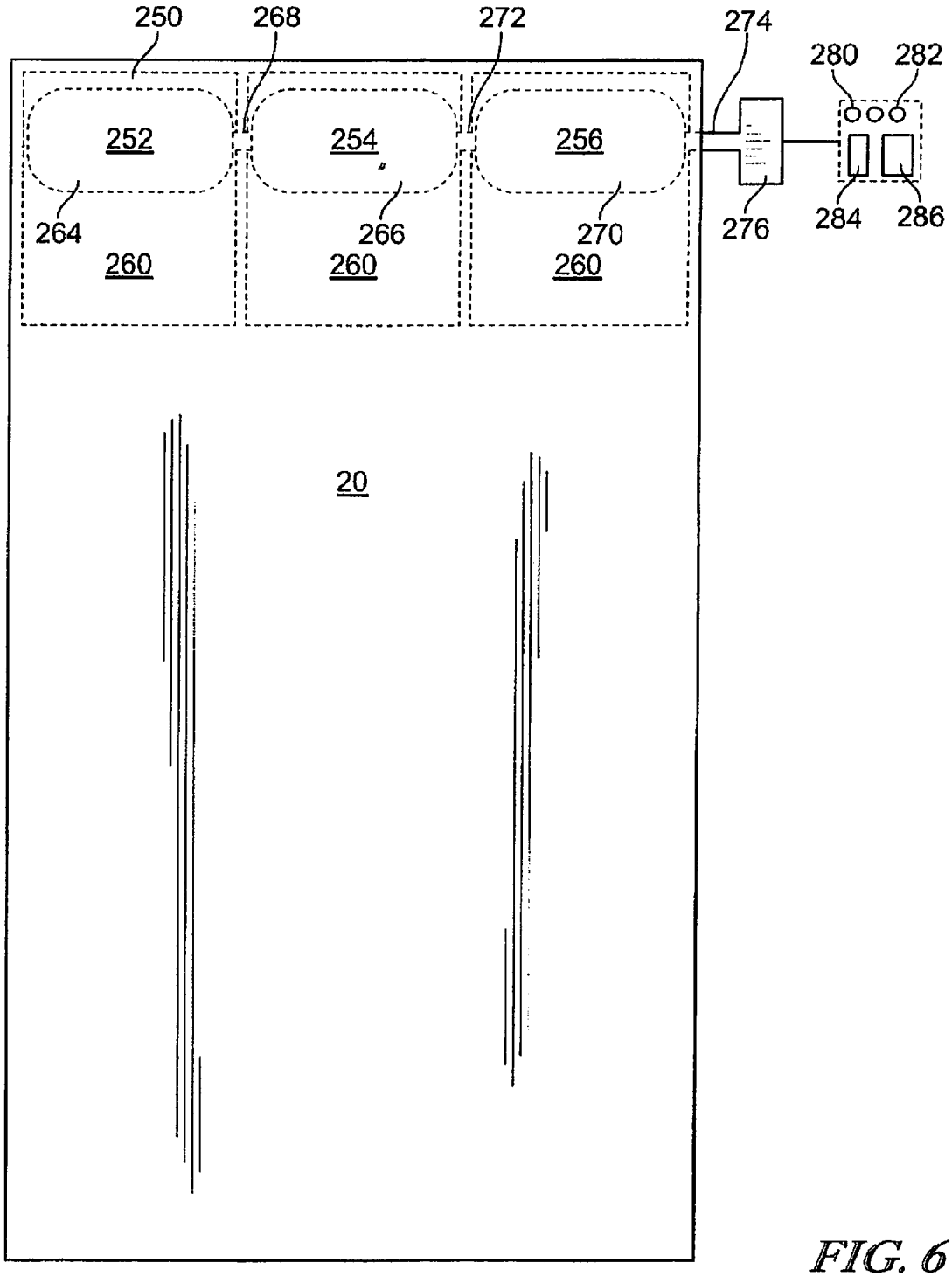
FIG. 6 is a top plan view of yet another embodiment of a mattress support positioned under a mattress.

FIG. 6 illustrates an elevation assembly 250 in dashed lines positioned between the mattress 20 and the bed frame 12. The elevation assembly 250 includes a left section 252, a middle section 254, and a right section 256. In some embodiments, the sections 252, 254, 256 are sized between 12 inches and 24 inches. The sections 252, 254, 256 may be interchangeable to fit various sized mattresses, e.g. twin, full, double, queen, and king. It may be appreciated that other mattress sizes may be contemplated. Each section 252, 254, and 256 includes a top plate 260 and a base plate (not shown, but as described above). A bladder 262 is positioned within each section 252, 254, and 256 between the top plate 260 and the base plate. Each bladder 262 is inflatable and deflatable between a raised position and a lowered position, as described above. A left bladder 264 is fluidly coupled to a middle bladder 266 by a hose 268. The middle bladder 266 is fluidly coupled to a right bladder 270 by a hose 272. A hose 274 fluidly couples the right bladder 270 to a pump 276. In some embodiments, any one of the left bladder 264 and the middle bladder 266 may be fluidly coupled to the pump 276. The pump 276 discharges air into the right bladder 270 through the hose 274. The air then flows from the right bladder 270 to the middle bladder 266 through the hose 272. The air then flows from the middle bladder 266 to the left bladder 264 through the hose 268. That is, the right bladder 270, the middle bladder 266, and the left bladder 264 are inflated in unison. In some embodiments, each of the right bladder 270, middle bladder 266, and left bladder 264 may have its own pump.

An optional control panel 280 may include controls 282 to operate the bladders 264, 266, and 270. The control panel 280 may be retroactively secured to the bed frame 12. Optionally, the control panel 280 may be positioned next to the bed 10 such that the control panel 280 is within reach of the bed 10. Alternatively or additionally, the control panel 280 may be incorporated into a patient pendant that is within reach of the bed 10. The control panel 280 may include a meter 284 that measures the pressure in each of the bladders 264, 266, and 270. The pressure and/or a height of the section 252, 254, 256 may be displayed on a display 286 of the control panel 280. In yet another embodiment, the controls 282, meter 284, and display 286 are incorporated into the pump 276.

Figure 7:
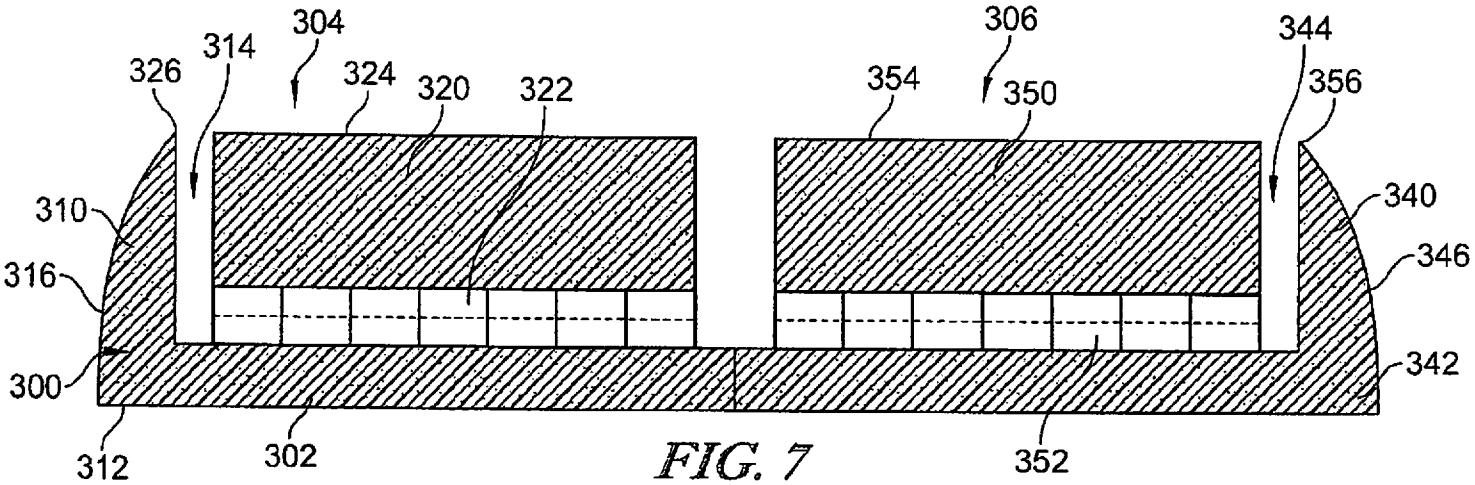
FIG. 7 is a cross-sectional view of a mattress support in accordance with an embodiment and taken along line 7-7 shown in FIG. 8.

FIG. 7 is a cross-sectional view of a mattress support 300 having a base 302. The base 302 may be formed from a foam material. In some embodiments, the base is formed from wood, plastic, or any other suitable material. The base 302 is formed from a left half 304 and a right half 306. The left half 304 and the right half 306 are positioned adjacent one another to form the base 302. In some embodiments, the left half 304 and the right half 306 are coupled together, as described in more detail below.

The left half 304 has a left side 310 that is positioned outside of the mattress 20 and the bed frame 12. The left side 310 extends upward from a bottom panel 312 and includes an angled outer surface 316 that facilitates sliding the mattress support 300 under the mattress 20 if the mattress support 300 is inserted from the right side of the mattress 20. The left side 310 may be configured to support a siderail. A nest 314 is defined by the left side 310 and the bottom panel 312. A left top plate 320 is nested within the nest 314 and coupled to the bottom panel 312 via a hinge 322. A top surface 324 of the left top plate 320 is substantially planar with a top surface 326 of the left side 310. A bladder (not shown) is positioned between the bottom panel 312 and the top plate 320. The bladder and the top plate 320 are nested within the base 302. The bladder is configured move the top plate 320 relative to the bottom panel 312, as described above.

The right half 306 has a right side 340 that is positioned outside of the mattress 20 and the bed frame 12. The right side 340 extends upward from a bottom panel 342 and includes an angled outer surface 346 that facilitates sliding the mattress support 300 under the mattress 20 if the mattress support 300 is inserted from the left side of the mattress 20. In some embodiments, the bottom panel 342 is coupled to the bottom panel 312. The right side 340 may be configured to support a siderail. A nest 344 is defined by the right side 340 and the bottom panel 342. A right top plate 350 is nested within the nest 344 and coupled to the bottom panel 342 via a hinge 352. A top surface 354 of the right top plate 350 is substantially planar with a top surface 356 of the right side 340. In some embodiments, the right top plate 350 is coupled to the left top plate 320, as described below. A bladder (not shown) is positioned between the bottom panel 342 and the top plate 350. The bladder and the top plate 350 are nested within the base 302. The bladder is configured move the top plate 350 relative to the bottom panel 342, as described above.

Figure 8:
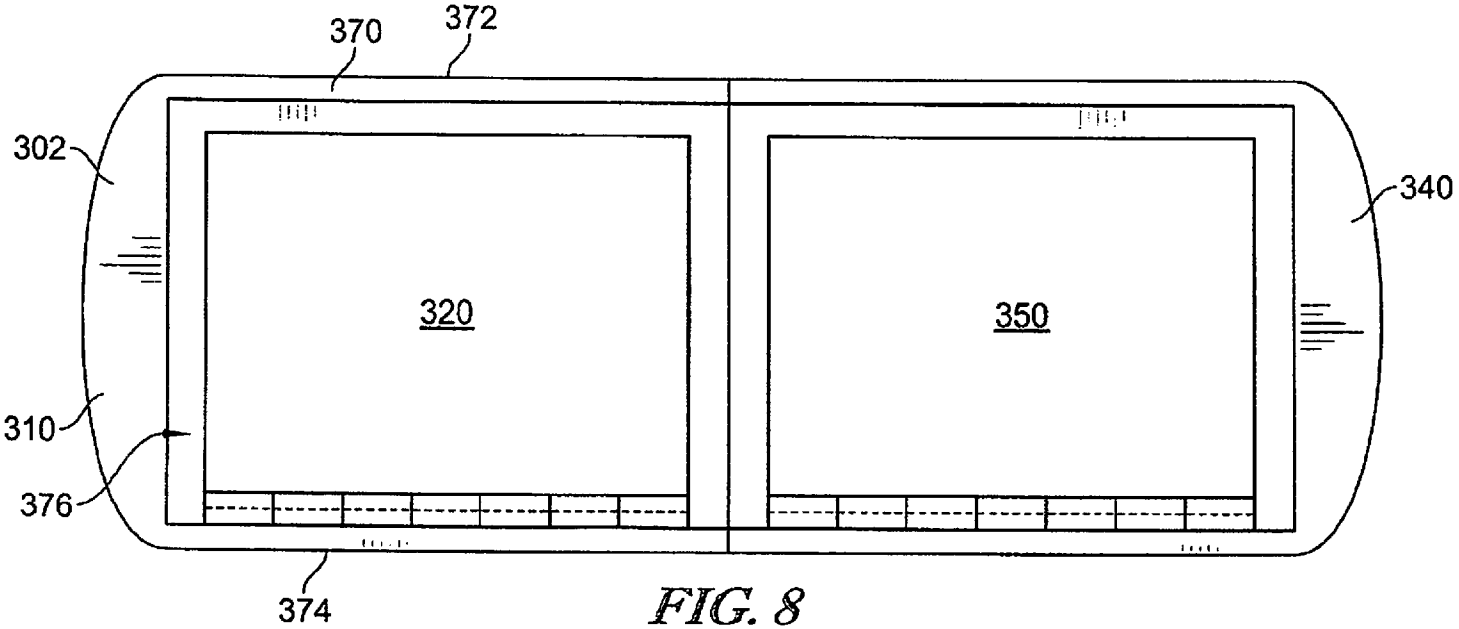
FIG. 8 is a top view of the mattress support shown in FIG. 7.

As illustrated in FIG. 8, the base 302 includes an outer frame 370 that includes a head end 372 joined to a foot end 374 by the left side 310 and the right side 340. The outer frame 370 defines a nest 376 that includes the nest 314 and the nest 344. The left top plate 320 and the right top plate 350 are nested within the nest 376. The left top plate 320 and the right top plate 350 are surrounded by the outer frame 370.

Figure 9:
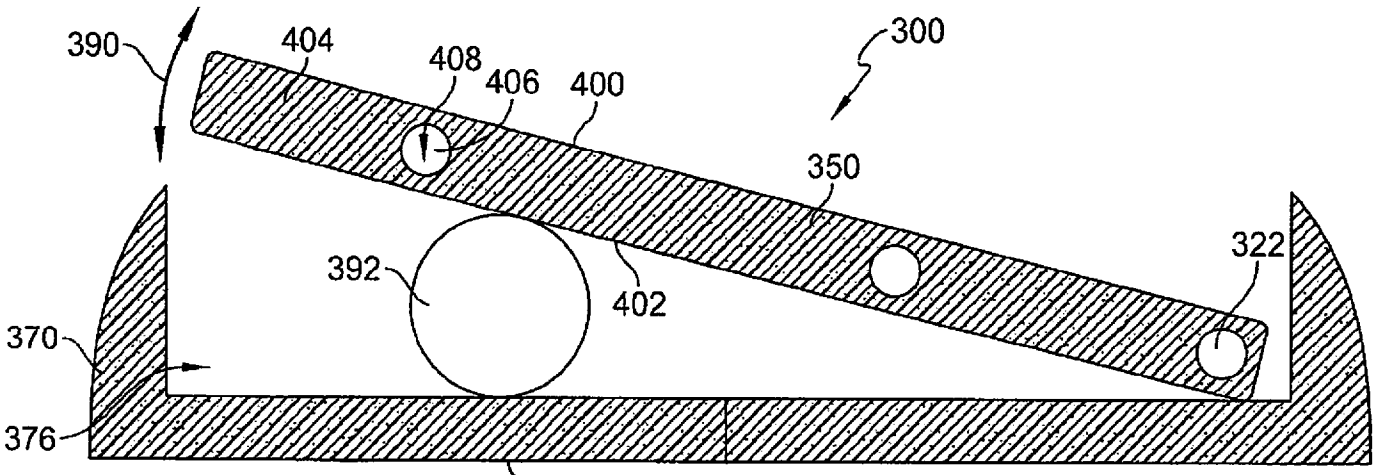
FIG. 9 is a cross-sectional view of a mattress support in accordance with another embodiment and taken along line 9-9 shown in FIG. 10.

FIG. 9 illustrates a side cross-sectional view of the mattress support 300 and the right top plate 350. Although FIG. 9 is described with respect to the right top plate 350, it should be appreciated that the left top plate 320 (shown in FIGS. 7 and 8) functions in the same manner as the right top plate 350. The right top plate 350 is nested in the nest 376 defined by the outer frame 370. The right top plate 350 is coupled to the base 302 by the hinge 322. The hinge 322 enables the right top plate 350 to rotate with respect to the base 302 and the outer frame 370. The right top plate 350 rotates about arrow 390 between a nested position (not shown) a raised position (shown). The right top plate 350 is raised and lowered by the bladder 392. Specifically, the bladder 392 is inflated or deflated, as described above, to raise and lower the right top plate 350.

The right top plate 350 includes a top surface 400 that is configured to support the mattress 20. Although the right top plate 350 may be formed from foam, the right top plate 350 is rigid so that the right top plate 350 and the top surface 400 do not deform under the weight of the mattress 20. A bottom surface 402 of the right top plate 350 is coupled to the bladder 392 such that the bladder 392 pushes against the bottom surface 402 to raise the right top plate 350. A side wall 404 extends between the top surface 400 and the bottom surface 402. A pair of apertures 406 extends into the right top plate 350 from a pair of openings 408 formed in the side wall 404. The apertures 406 are configured to receive a post or rod (not shown).

Figure 10:
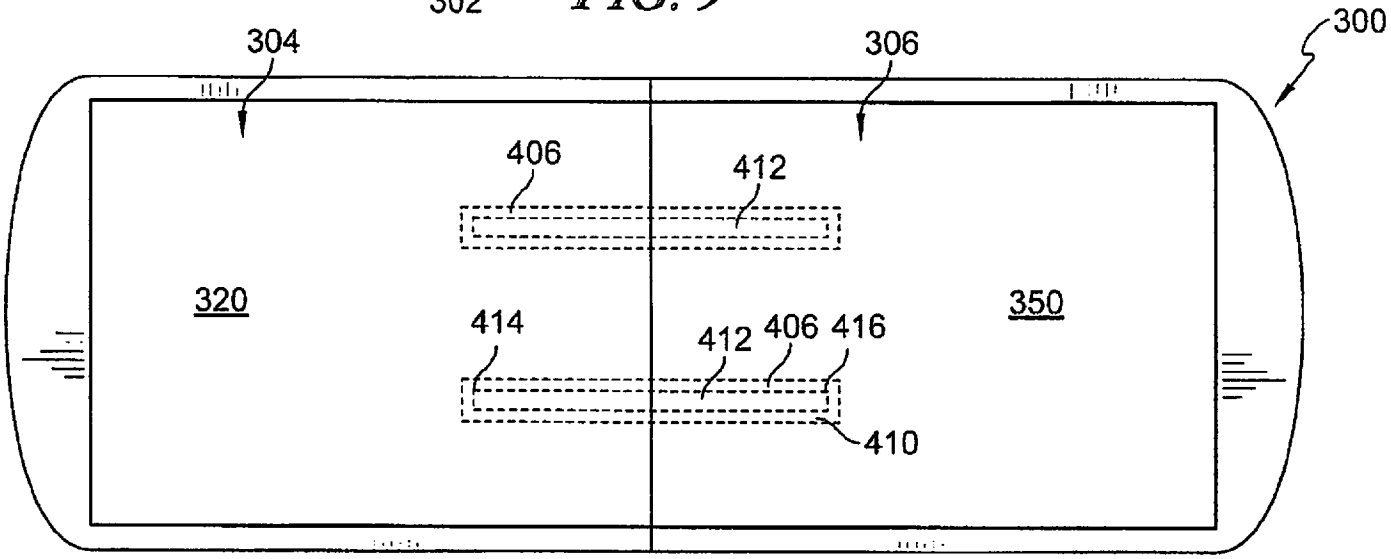
FIG. 10 is a top plan view of the mattress support shown in FIG. 9.

Referring to FIG. 10, the left half 304 and the right half 306 of the mattress support 300 are coupled to one another. The left top plate 320 is positioned adjacent to the right top plate 350. The apertures 406 are shown in each of the left top plate 320 and the right top plate 350 in dashed lines. The apertures 406 of the left top plate 320 are aligned with the apertures 406 of the right top plate 350 to form elongated channels 410 extending between the left top plate 320 and the right top plate 350. A rod or post 412 is inserted into each channel 410. The rod 412 extends between the left top plate 320 and the right top plate 350. A left end 414 of each post 412 is positioned in the aperture 406 of the left top plate 320, and a right end 416 of each post 412 is positioned in the aperture 406 of the right top plate 350. The post 412 couples the left top plate 320 to the right top plate 350.

Because the left top plate 320 is coupled to the right top plate 350, the left top plate 320 and the right top plate 350 move in unison. That is, the left top plate 320 and the right top plate 350 are raised and lowered to the same height simultaneously. If the bladder 392 under the right top plate 350 is inflated more quickly than the bladder 392 under the left top plate 320, the left top plate 320 will still rise along with the right top plate 350 until the bladder 392 under the left top plate 320 catches up to the bladder 392 under the right top plate 350. Likewise, if the bladder 392 under the left top plate 320 is inflated more quickly than the bladder 392 under the right top plate 350, the right top plate 350 will still rise along with the left top plate 320 until the bladder 392 under the right top plate 350 catches up to the bladder 392 under the left top plate 320. It will be appreciated that the same principles regarding the unitary movement of the left top plate 320 and the right top plate 350 also apply to movement of the plates 320, 350 when the bladders 392 are being deflated.

Figure 11:
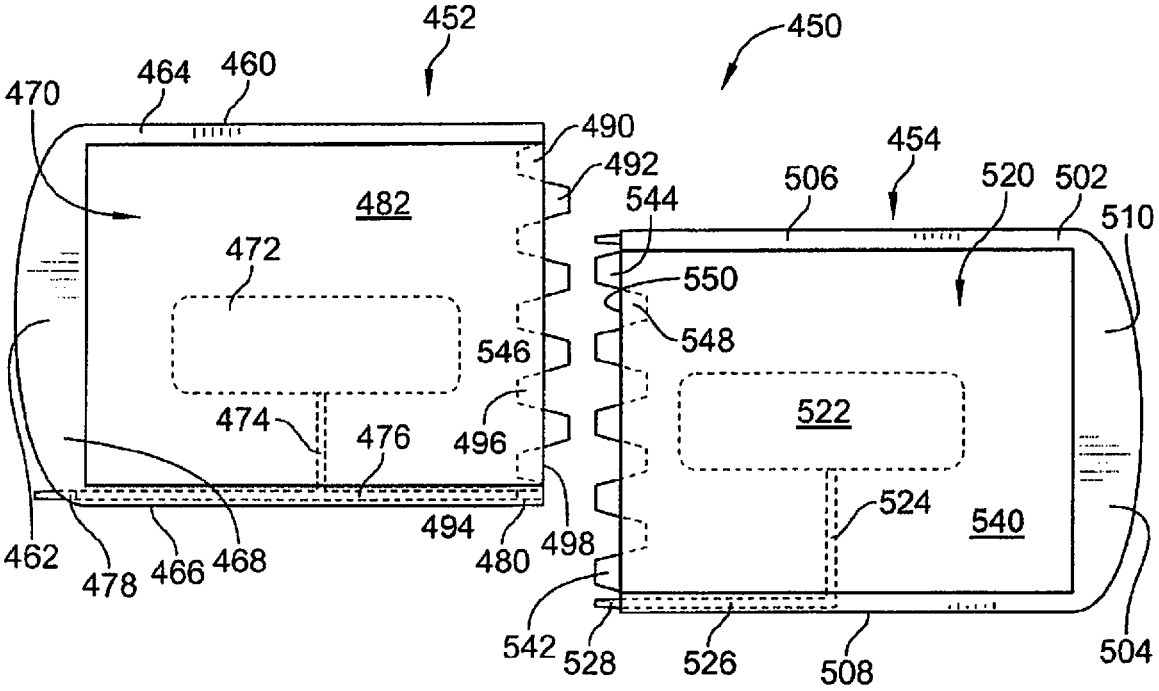
FIG. 11 is a top plan view of an embodiment of a mattress support divided into a left half and a right half.

Referring to FIG. 11, a mattress support 450 may incorporate several of the features of the mattress supports described herein. The mattress support 450 includes a left half 452 and a right half 454. The left half 452 includes a base 460 having an outer frame 462. The outer frame 462 includes a head end 464 and a foot end 466. A left side 468 extends between the head end 464 and the foot end 466. The left side 468 may be configured to receive a siderail, as described herein. The head end 464, the foot end 466 and the left side 468 form a nest 470. A bladder 472 is positioned within the nest 470. The bladder 472 is coupled to a hose 474 that extends from the bladder 472 to a hose 476 extending through the foot end 466 of the base 460. An inlet hose 478 extends outward from the foot end 466 of the base 460 and is coupled to the hose 476. The inlet hose 478 is configured to couple to a pump (not shown). An outlet 480 is formed in the hose 476 at an end opposite the inlet hose 478. A top plate 482 is positioned over the bladder 472 and within the nest 470. The bladder 472 is configured to raise and lower the top plate 482, as described herein.

A right end 490 of the base 460 includes a plurality of posts 492 extending from an outer surface 494. A plurality of apertures 496 extend into the right end 490 from openings 498 formed in the outer surface 494. Each aperture 496 is positioned next to a post 492. That is, the apertures 496 are positioned between the posts 492 so that the apertures 496 and the posts 492 alternate along the right end 490.

The right half 454 includes a base 502 having an outer frame 504. The outer frame 504 includes a head end 506 and a foot end 508. A right side 510 extends between the head end 506 and the foot end 508. The right side 510 may be configured to receive a siderail, as described herein. The head end 506, the foot end 508 and the right side 510 form a nest 520. A bladder 522 is positioned within the nest 520. The bladder 522 is coupled to a hose 524 that extends from the bladder 522 to a hose 526 extending through the foot end 508 of the base 502. An inlet hose 528 extends outward from the foot end 508 of the base 502 and is coupled to the hose 526. The inlet hose 528 is configured to couple to the outlet 480 of the base 460 of the left half 452. A top plate 540 is positioned over the bladder 522 and within the nest 520. The bladder 522 is configured to raise and lower the top plate 540, as described herein.

A left end 542 of the base 502 includes a plurality of posts 544 extending from an outer surface 546. A plurality of apertures 548 extend into the left end 542 from openings 550 formed in the outer surface 546. Each aperture 548 is positioned next to a post 544. That is, the apertures 548 are positioned between the posts 544 so that the apertures 548 and the posts 544 alternate along the left end 542.

Figure 12:
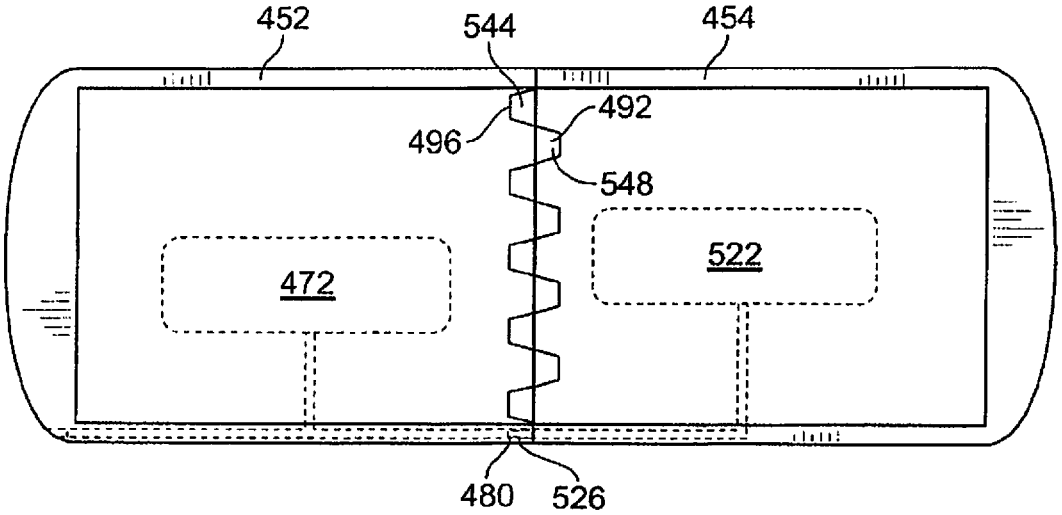
FIG. 12 is a top plan view of the mattress support shown in FIG. 11 with the left half coupled to the right half.

The left half 452 is illustrated coupled to the right half 454 in FIG. 12. The posts 492 of the left half 452 are inserted into the apertures 548 of the right half 454 so that the right end 490 of the left half 452 is positioned adjacent and coupled to the left end 542 of the right half 454. Likewise, the posts 544 of the right half 454 are inserted into the apertures 496 of the left half 452. The posts 492, 544 may rest within the respective aperture 548, 496. In some embodiments, the posts 492, 544 are friction fit within the respective aperture 548, 496. In such an embodiment, the posts 492, 544 may be formed with a larger outer diameter than the inner diameter of the respective aperture 548, 496 so that the posts 492, 544 are press fit into the respective aperture 548, 496. In some embodiments, an outer surface of the posts 492, 544 may include a surface texture, such as a rib or detent, that deforms and friction fits the posts 492, 544 within the respective aperture 548, 496.

The inlet hose 528 of the right half 454 is inserted into the outlet 480 of the left half 452 to create a fluid flow path from the left half 452 to the right half 454 by way of the hoses 476 and 526. In some embodiments, the pump may couple to the hose 526. In such an embodiment, the air may flow from the hose 526 of the right half 454 into the hose 476 of the left half 452. In some embodiments, each half 452, 454 may include an inlet to couple to the pump. The inlet of the half 452, 454 that is not coupled to the pump may be closed with a plug or shut off valve (not shown). Air from the pump travels through hoses 476 and 526 to the bladders 472 and 522 to inflate and deflate the bladders 472, 522. In some embodiments, each half 452, 454 may be couple to a separate pump. In such embodiments, the two pumps may jointly inflated or deflate the bladders 472, 522. Alternatively, the connection between the inlet hose 528 and the outlet 480 may be eliminated so that each pump individually inflates and deflates the respective half 452, 454.

Figure 13:
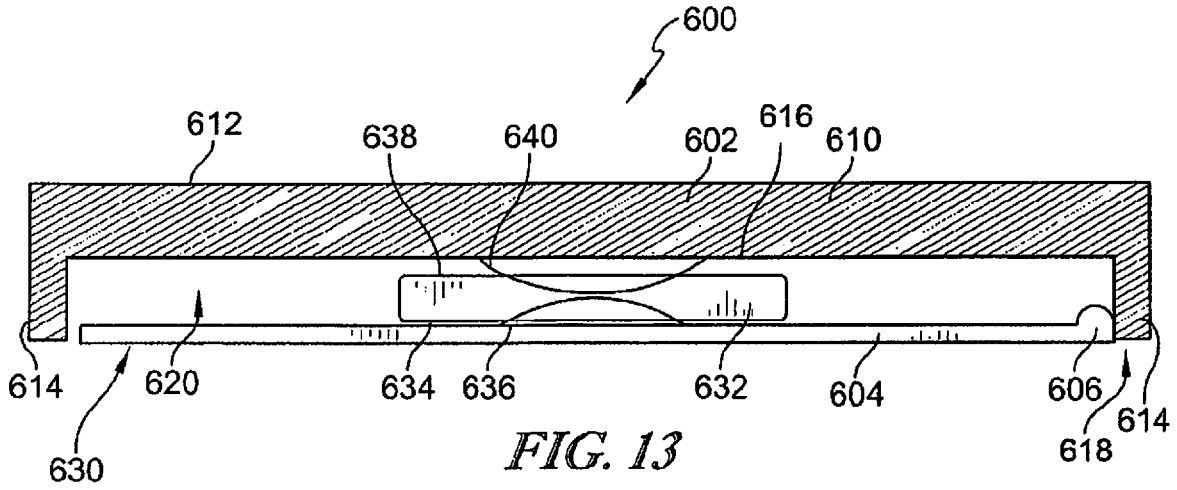
FIG. 13 is a side elevation view of another embodiment of a mattress support in a lowered position.
Figure 14:
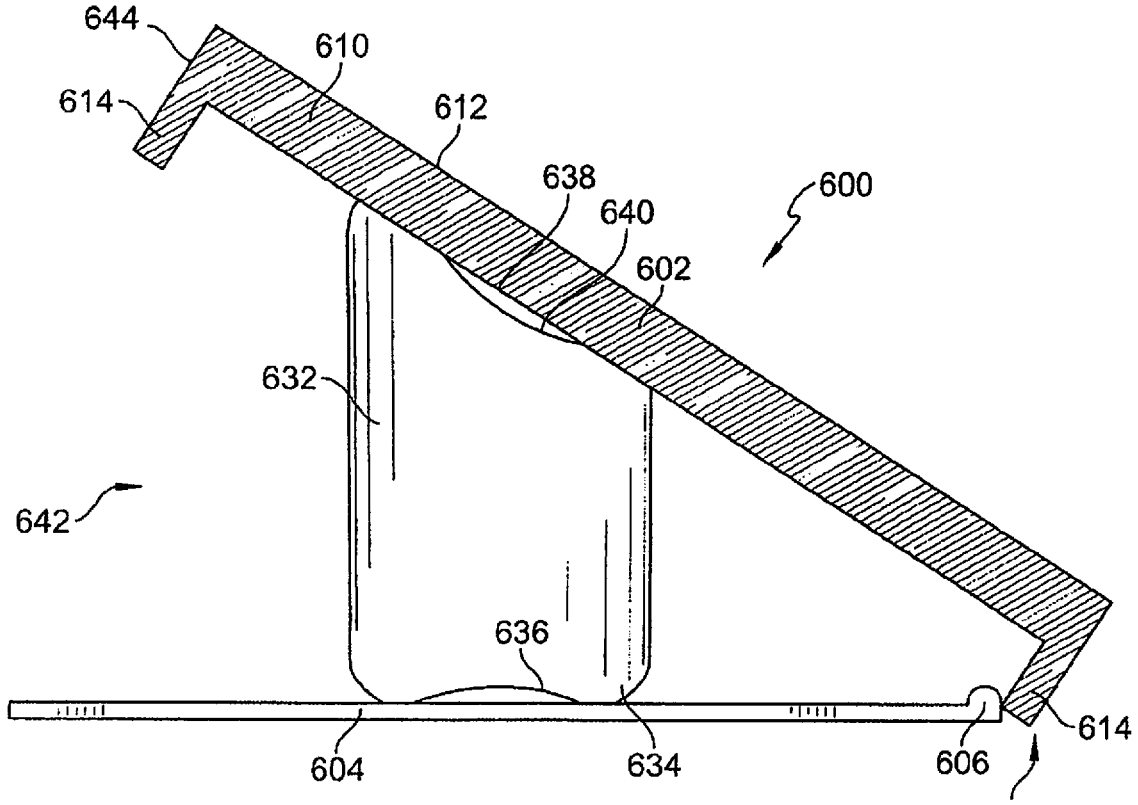
FIG. 14 is a side elevation view of the mattress support shown in FIG. 13 and in a raised position.

FIGS. 13-14 illustrate another embodiment of a mattress support 600 that may incorporate several of the mattress support features described herein. The mattress support 600 includes a top plate 602 coupled to a base plate 604 via a hinge 606. The base plate 604 is configured to rest on the frame 12 of the bed 10. The top plate 602 supports the mattress 20. The top plate 602 includes a body 610 having a top surface 612 upon which the mattress 20 rests. A pair of legs 614 extends from a bottom surface 616 of the top plate 602. The hinge 606 is coupled one of the legs 614 at a foot end 618 of the mattress support 600. The body 610 and the legs 614 define a cavity 620. The base plate 604 is configured to position within the cavity 620 when the mattress support 600 is in a lowered position 630 (shown in FIG. 13). The base plate 604 positions between the legs 614.

A bladder 632 is positioned within the cavity 620 between the base plate 604 and the top plate 602. A bottom 634 of the bladder 632 is coupled to a top surface of the base plate 604. In some embodiments, the bottom 634 of the bladder 632 is coupled to the base plate 604 by a strap 636 (shown in FIG. 13). A top 638 of the bladder 632 is coupled to the bottom surface 616 of the top plate 602. In some embodiments, the top 638 of the bladder 632 is coupled to the top plate 602 by a strap 640. The bladder 632 is fluidly coupled to a pump (not shown) that inflates and deflates the bladder 632 as described herein. The bladder 632 is inflated and deflated to move the top plate 602 relative to the base plate 604 between the lowered position 630 and a raised position 642 (shown in FIG. 14). The top plate 602 rotates about the hinge 606 at the foot end 618 and a head end 644 of the mattress support 600 is raised and lowered to angle the top plate 602 relative to the base plate 604. In some embodiments, the top plate 602 may be moved to an intermediate position between the lowered position 630 and the raised position 642.

Figure 15:
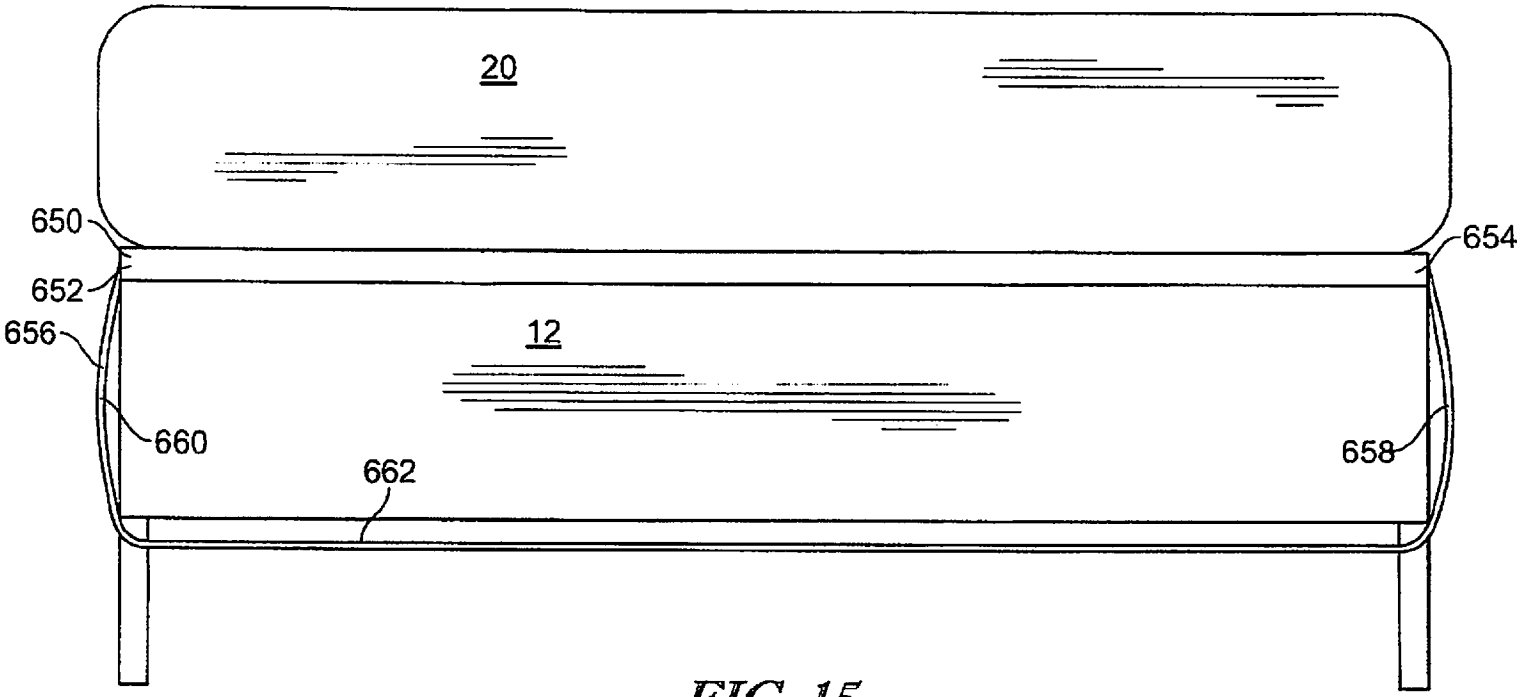
FIG. 15 is a head end elevation view of a mattress support positioned between a mattress and a bed frame.

FIG. 15 illustrates an embodiment for securing a mattress support 650 between the mattress 20 and the frame 12. It should be noted that the mattress support 650 may be embodied as any of the mattress supports described herein. The mattress support 650 is illustrated at a head end of the mattress 20. The mattress support 650 includes a left side 652 and a right side 654. A strap 656 includes a right end 658 coupled to the right side 654 of the mattress support 650, and a left end 660 coupled to the left side 652 of the mattress support 650. The strap 656 includes a middle section 662 extending between the left end 660 and the right end 658. The middle section 662 is passed below the frame 12, so that the strap 656 wraps around the frame 12. The strap is tightened using any conventional means for tightening a strap, so that the middle section 662 of the strap 656 is secured to a bottom surface 664 of the frame 12.

Figure 16:
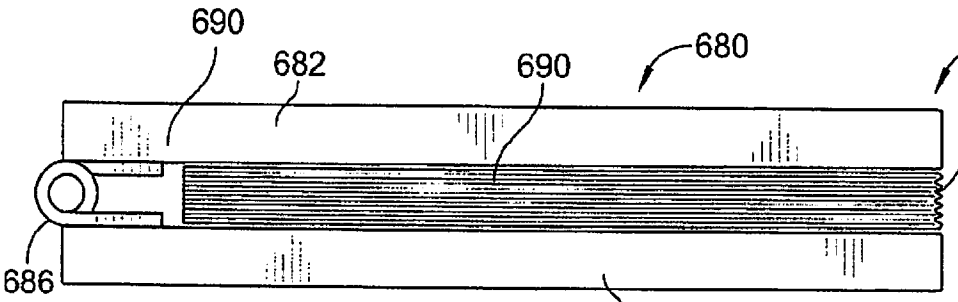
FIG. 16 is a perspective view of a mattress support in a lowered configuration.
Figure 17:
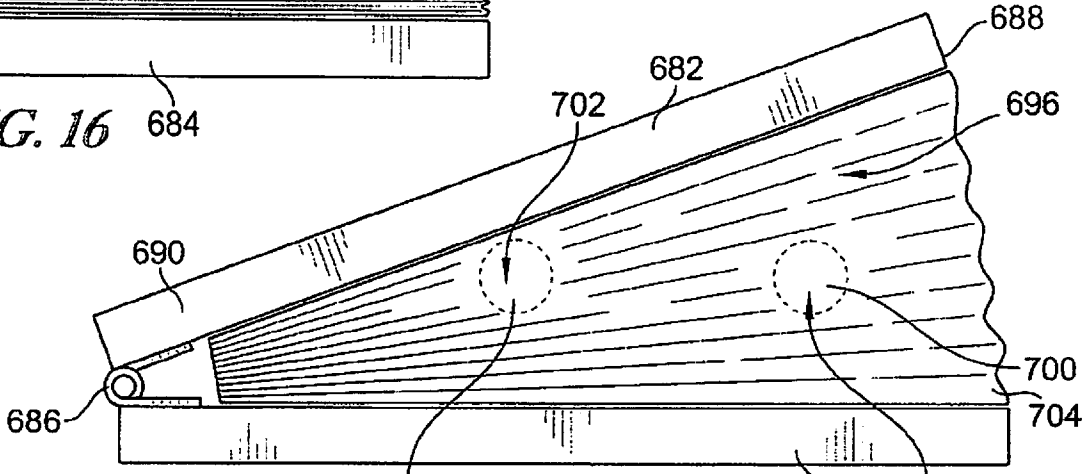
FIG. 17 is a perspective view of the mattress support shown in FIG. 16 and in a raised configuration.
Figure 18:
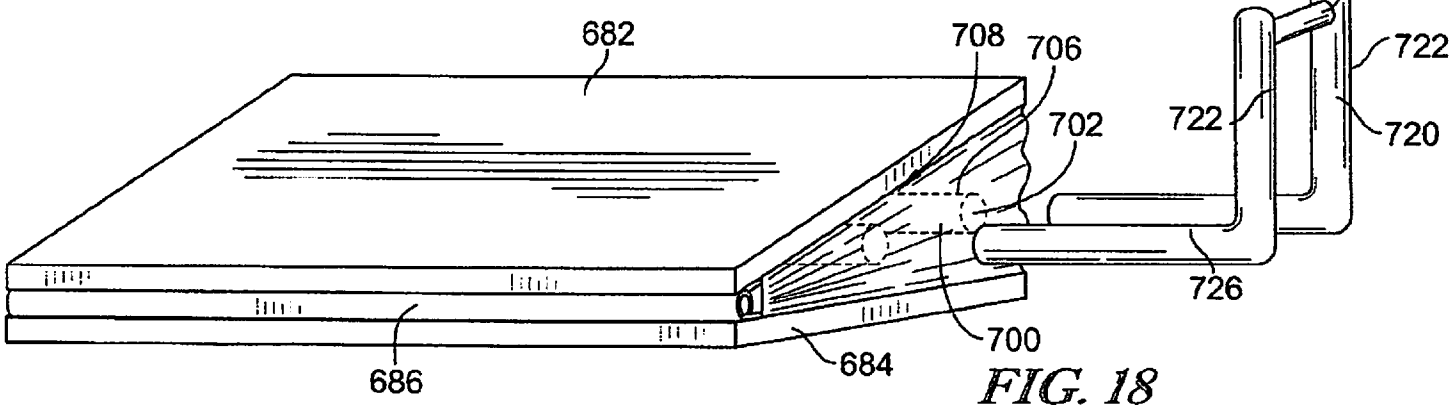
FIG. 18 is a perspective view of a siderail being coupled to the mattress support shown in FIG. 17.

FIGS. 16-18 illustrate an embodiment of a mattress support 680 having a top plate 682 hingedly attached to a base plate 684 by a hinge 686. The top plate 682 includes a free end 688 and a fixed end 690. The fixed end 690 is secured to the base plate 684 by the hinge 686 so that the free end 688 may be raised and lowered relative to the base plate 684. A bladder 696 is positioned between the top plate 682 and the base plate 684. The bladder 696 is fluidly coupled to a pump (not shown) and configured to be inflated and deflated to raise and lower the top plate 682 between a lowered position 692 (shown in FIG. 16) and a raised position 694 (shown in FIG. 17). In some embodiments, the bladder 696 may move the top plate 682 to an intermediate position between the lowered position 692 and the raised position 694.

As illustrated in FIGS. 17-18, the bladder 696 includes a pair of apertures 700 extending from openings 702 formed in the side 704 of the bladder 696. Although two apertures 700 are illustrated, the bladder 696 may include any number of apertures 700. The apertures 700 are defined by a sidewall 706 extending into the bladder 696 to an end wall 708. The apertures 700 are closed off to the inside of the bladder 696 so that air does not escape the bladder 696 through the apertures 700. The apertures 700 are opened when the bladder 696 is inflated. In some embodiments, the apertures 700 are reinforced by materials such as metal or plastic embedded in the sidewall 706 and end wall 708. In other embodiments, the apertures 700 are reinforced by the pressure of the air in the inflated bladder 696.

As illustrated in FIG. 18, the apertures 700 are configured to receive a siderail 720. The siderail 720 includes a pair of posts 722 extending from a rail 724. A leg 726 extends outward from each post 722. The legs 726 are configured to extend parallel to a top surface of the mattress 20. The legs 726 are configured to be inserted into the apertures 700 to secure the siderail 720 to the mattress support 680. The rail 724 is configured to extend above the mattress 20 when the siderail 720 is secured to the mattress support 680.

It should be noted that the apertures 700 may also be utilized to secure the mattress support 680 to another mattress support 680. That is, a pair of mattress supports 680 may be positioned next to one another and inflated so that the apertures 700 of the two mattress supports 680 are aligned. Similar to the embodiment shown in FIGS. 9-10, a rod or post (not shown) may be inserted into the apertures 700 of the mattress supports 680 to join the mattress supports 680. Such an embodiment may be utilized to prevent the mattress supports 680 from separating during use.

Figure 20:
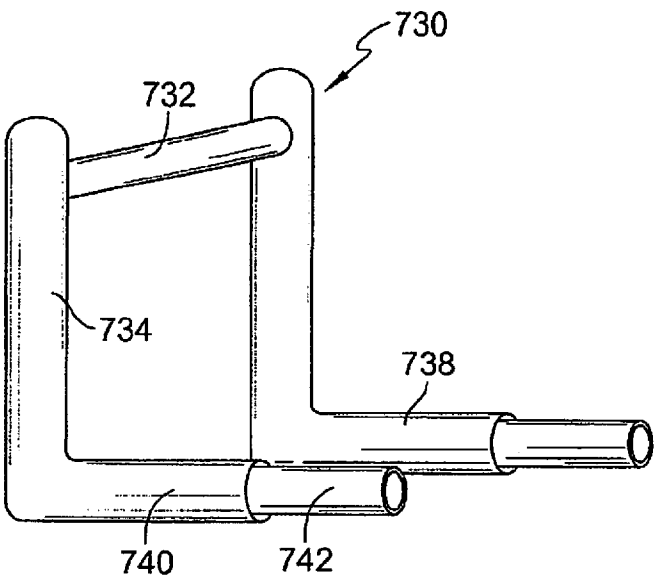
FIG. 20 is a perspective view of the siderail shown in FIG. 19 is a partially extended configuration.
Figure 21:
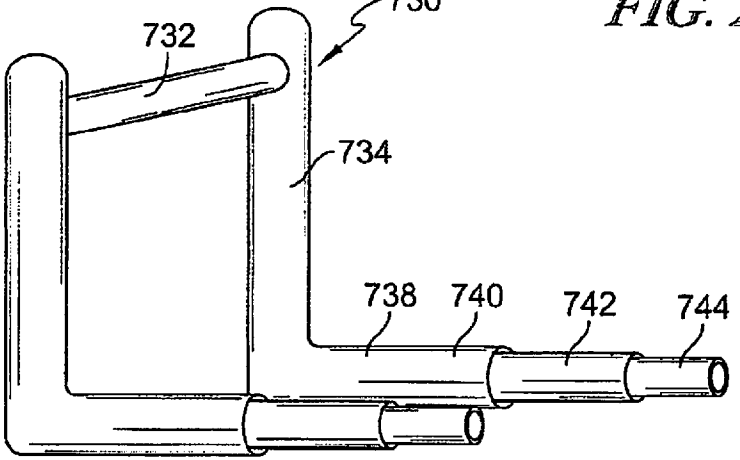
FIG. 21 is a perspective view of the siderail shown in FIGS. 19-20 and in a fully extended configuration.
Figure 19:
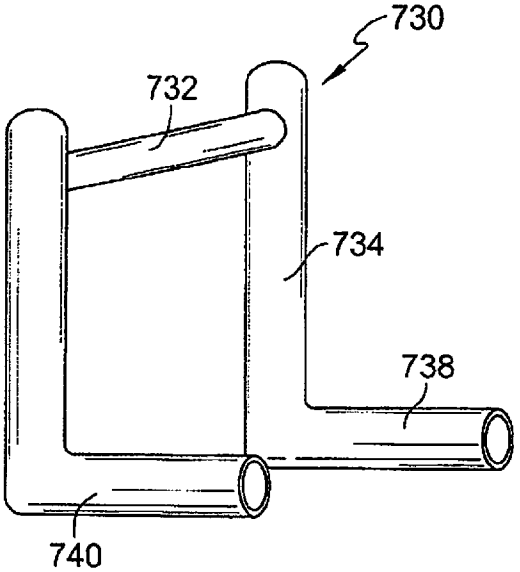
FIG. 19 is a perspective view of a siderail in a collapsed configuration.

FIGS. 19-21 illustrate an embodiment of a siderail 730 that may be used with the mattress supports described herein. The siderail 730 includes a rail 732 that is configured to position above the top surface of the mattress 20. A post 734 extends from each end of the rail 732. Although two posts 734 are illustrated, it will be appreciated that the siderail 730 may include any number of posts 734. Also the posts 734 are not required to extend from the ends 736 of the rail 732, but may extend from an intermediate position between the ends 736 of the rail 732. A leg 738 extends from each post 734. The legs 738 are configured to extend parallel to the top surface of the mattress 20. Each leg 738 includes a first section 740 that is coupled directly to the post 734. As shown in FIG. 20, a second section 742 of each leg 738 telescopes outward from the first section 740 to increase a length of the leg 738. As shown in FIG. 21, a third section 744 of each leg 738 telescopes outward from the second section 742 to further extend the length of each leg 738.

Figure 22:
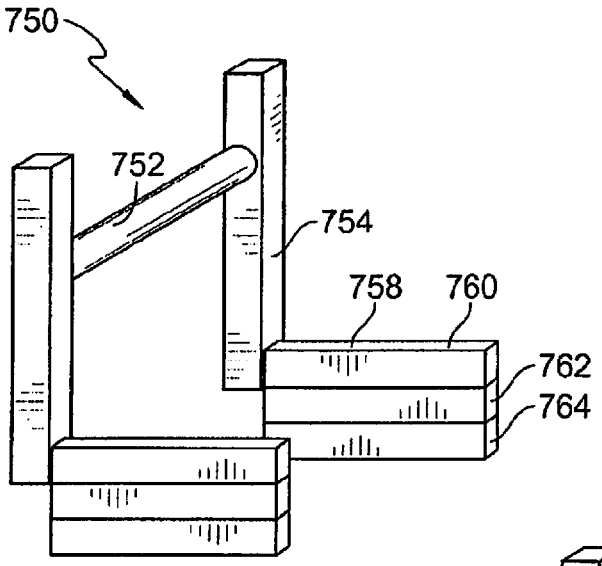
FIG. 22 is a perspective view of a siderail in a collapsed configuration.
Figure 23:
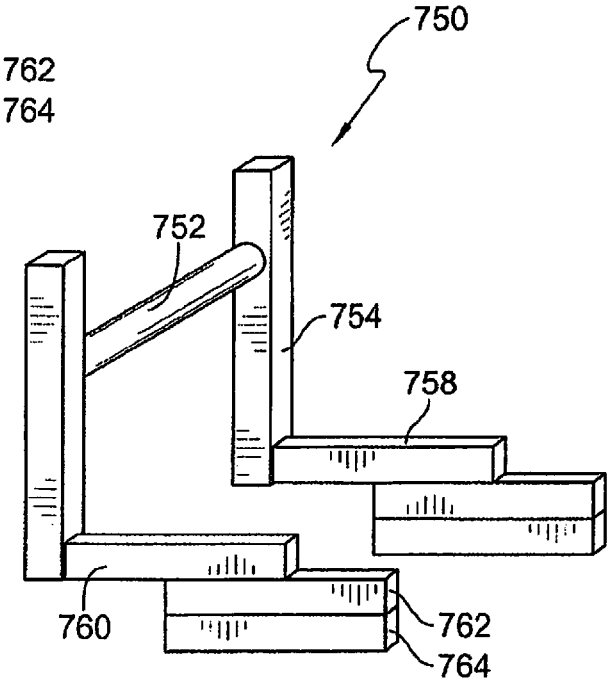
FIG. 23 is a perspective view of the siderail shown in FIG. 22 is a partially extended configuration.
Figure 24:
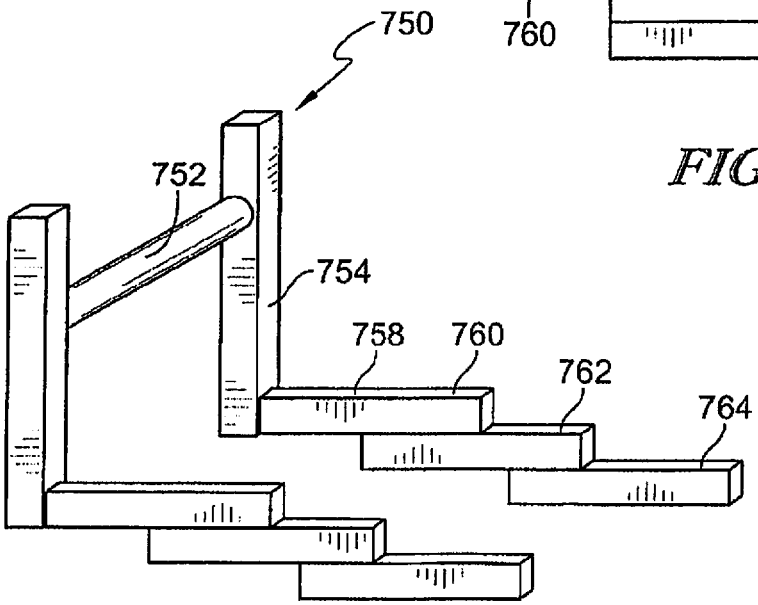
FIG. 24 is a perspective view of the siderail shown in FIGS. 22-23 and in a fully extended configuration.

FIGS. 22-24 illustrate another embodiment of a siderail 750 that may be used with the mattress supports described herein. The siderail 750 includes a rail 752 that is configured to position above the top surface of the mattress 20. A post 754 extends from each end of the rail 752. Although two posts 754 are illustrated, it will be appreciated that the siderail 750 may include any number of posts 754. Also the posts 754 are not required to extend from the ends 756 of the rail 752, but may extend from an intermediate position between the ends 756 of the rail 752. A leg 758 extends from each post 754. The legs 758 are configured to extend parallel to the top surface of the mattress 20. Each leg 758 includes a first section 760 that is coupled directly to the post 754. As shown in FIG. 23, a second section 762 of each leg 758 fans outward from the first section 760 to increase a length of the leg 758. As shown in FIG. 24, a third section 764 of each leg 758 fans outward from the second section 762 to further extend the length of each leg 758.

Figure 25:
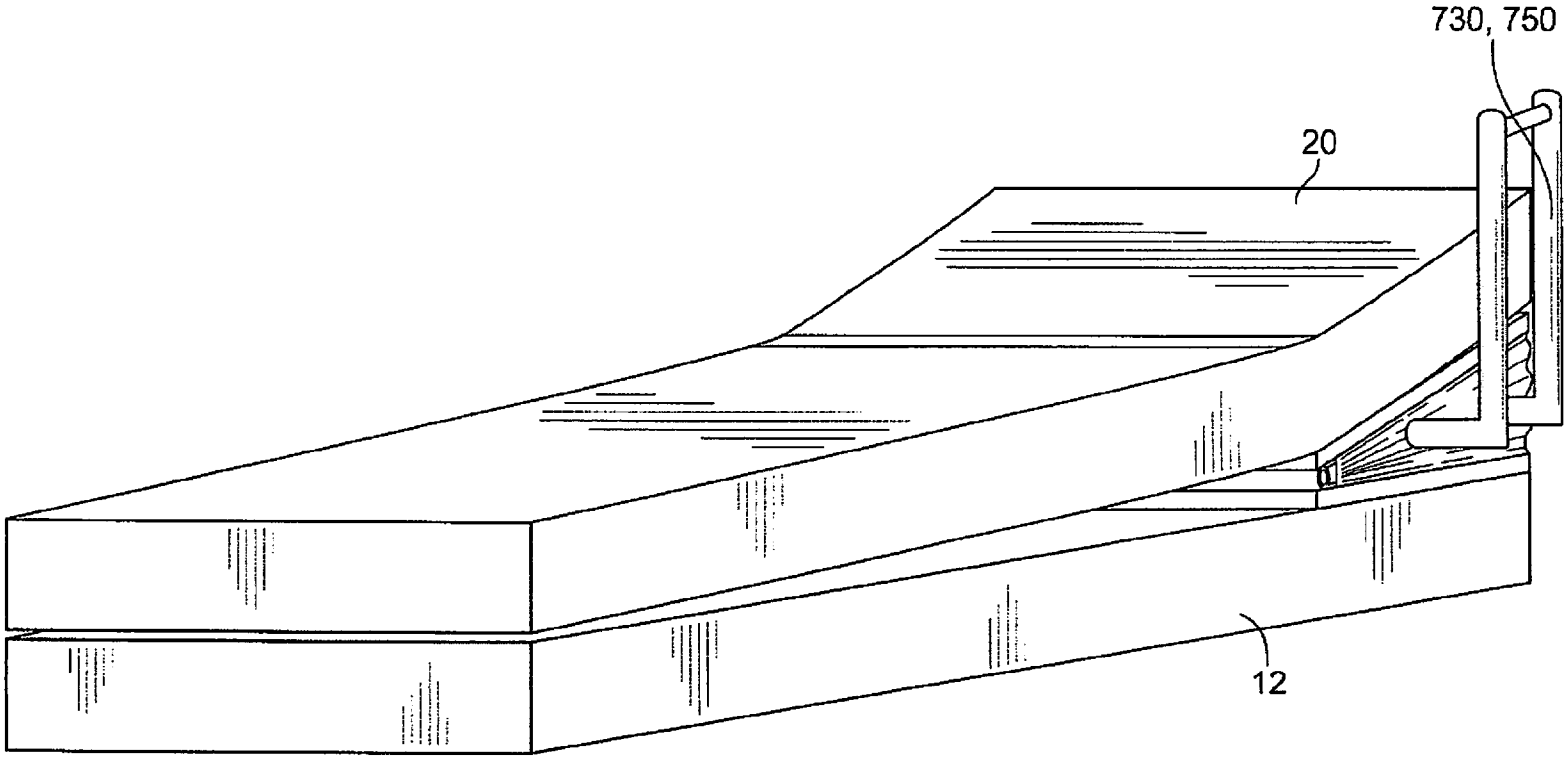
FIG. 25 is a perspective view of a siderail couple to a mattress support.

The legs 738 and 758 of siderails 730 and 750, respectively, are configured to be inserted into apertures formed in a side of a mattress support described herein. For example, FIG. 25 illustrates a siderail 730, 750 inserted into the apertures 700 described above with respect to FIGS. 17-18. It should be noted that the siderails 730, 750 may include any number of leg sections that corresponds to an overall required length of the leg 738, 758. With respect to the siderail 730, not all leg sections 740, 742, 744 are required to be telescoped outward to secure the siderail 730 to the mattress support. Likewise, with respect to siderail 750, not all leg sections 760, 762, 764 are required to be fanned outward to secure the siderail 750 to the mattress support.

Figure 26:
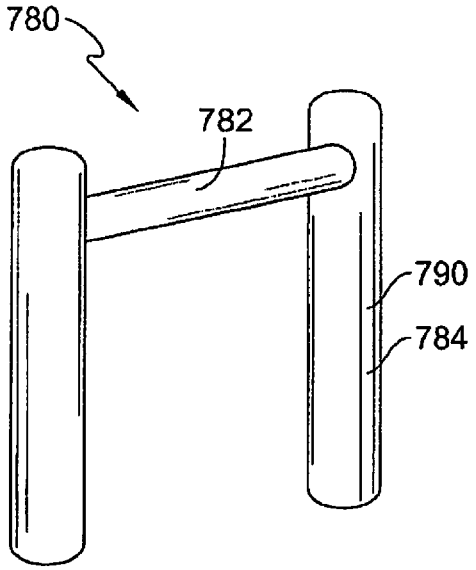
FIG. 26 is a perspective view of a siderail in a collapsed configuration.
Figure 27:
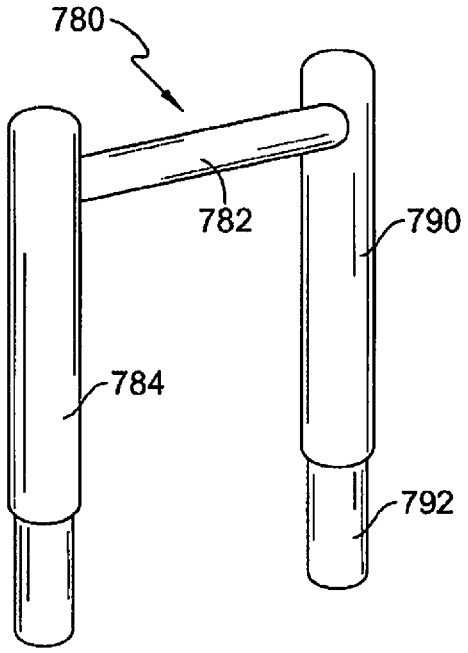
FIG. 27 is a perspective view of the siderail shown in FIG. 26 is a partially extended configuration.
Figure 28:
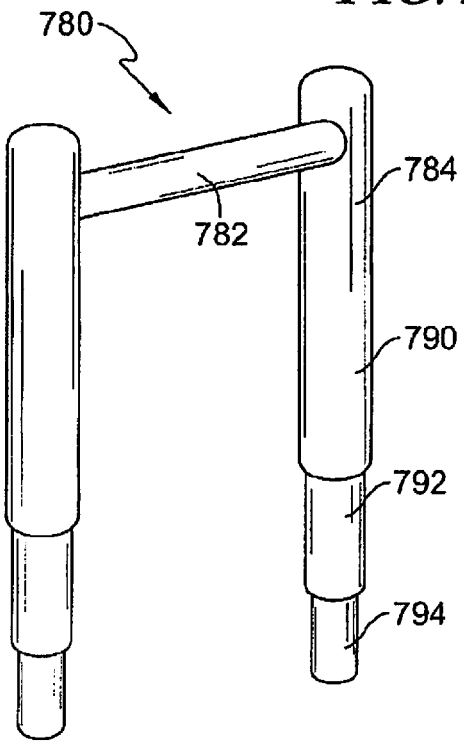
FIG. 28 is a perspective view of the siderail shown in FIGS. 26-27 and in a fully extended configuration.

FIGS. 26-28 illustrate an embodiment of a siderail 780 that may be used with the mattress supports described herein. The siderail 780 includes a rail 782 that is configured to position above the top surface of the mattress 20. A post 784 extends from each end of the rail 782. Although two posts 784 are illustrated, it will be appreciated that the siderail 780 may include any number of posts 784. Also the posts 784 are not required to extend from the ends 786 of the rail 782, but may extend from an intermediate position between the ends 786 of the rail 782. The posts 784 are configured to extend perpendicular to the top surface of the mattress 20. Each post 784 includes a first section 790 that is coupled directly to the rail 782. As shown in FIG. 26, a second section 792 of each post 784 telescopes outward from the first section 790 to increase a length of the post 784. As shown in FIG. 27, a third section 794 of each post 784 telescopes outward from the second section 792 to further extend the length of each post 784.

Figure 29:
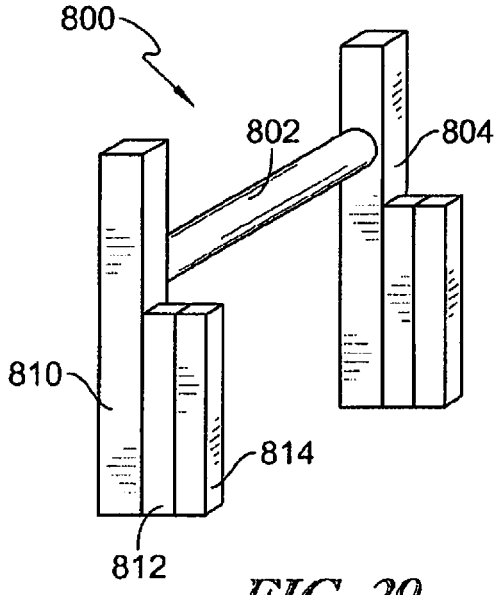
FIG. 29 is a perspective view of a siderail in a collapsed configuration.
Figure 30:
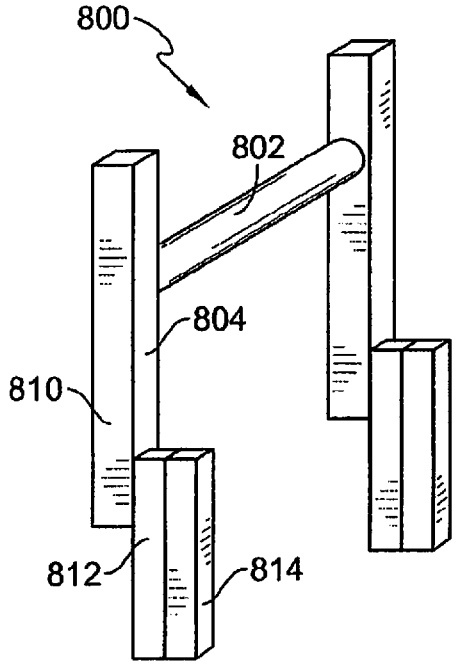
FIG. 30 is a perspective view of the siderail shown in FIG. 29 is a partially extended configuration.
Figure 31:
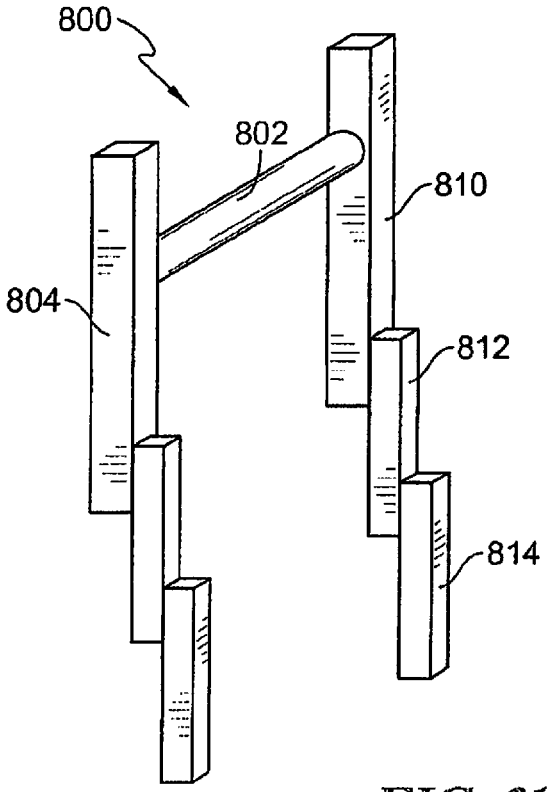
FIG. 31 is a perspective view of the siderail shown in FIGS. 29-30 and in a fully extended configuration.

FIGS. 29-31 illustrate another embodiment of a siderail 800 that may be used with the mattress supports described herein. The siderail 800 includes a rail 802 that is configured to position above the top surface of the mattress 20. A post 804 extends from each end of the rail 802. Although two posts 804 are illustrated, it will be appreciated that the siderail 800 may include any number of posts 804. Also the posts 804 are not required to extend from the ends 806 of the rail 802, but may extend from an intermediate position between the ends 806 of the rail 802. The posts 804 are configured to extend perpendicular to the top surface of the mattress 20. Each post 804 includes a first section 810 that is coupled directly to the rail 802. As shown in FIG. 29, a second section 812 of each post 804 fans outward from the first section 810 to increase a length of the post 804. As shown in FIG. 30, a third section 814 of each post 804 fans outward from the second section 812 to further extend the length of each post 804.

Figure 32:
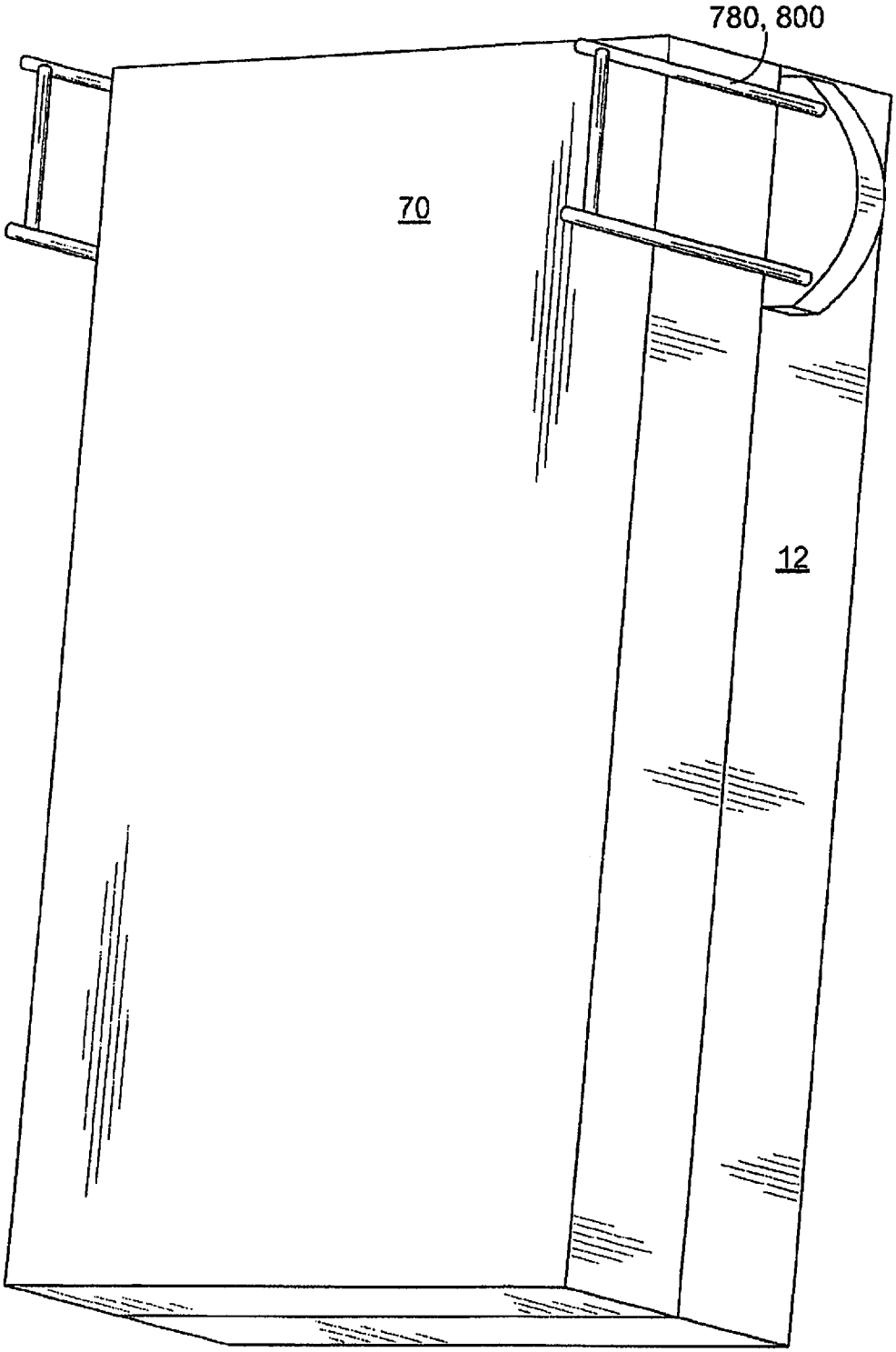
FIG. 32 is a perspective view of a siderail couple to a mattress support.

The posts 784 and 804 of siderails 780 and 800, respectively, are configured to be inserted into apertures formed in a side of a mattress support described herein. For example, FIG. 32 illustrates a siderail 780 and 800 inserted into the apertures 116 described above with respect to FIG. 4. It should be noted that the siderails 780, 800 may include any number of post sections that corresponds to an overall required length of the post 784, 804. With respect to the siderail 780, not all leg sections 790, 792, 794 are required to be telescoped outward to secure the siderail 780 to the mattress support. Likewise, with respect to siderail 800, not all leg sections 810, 812, 814 are required to be fanned outward to secure the siderail 800 to the mattress support.

Figure 33:
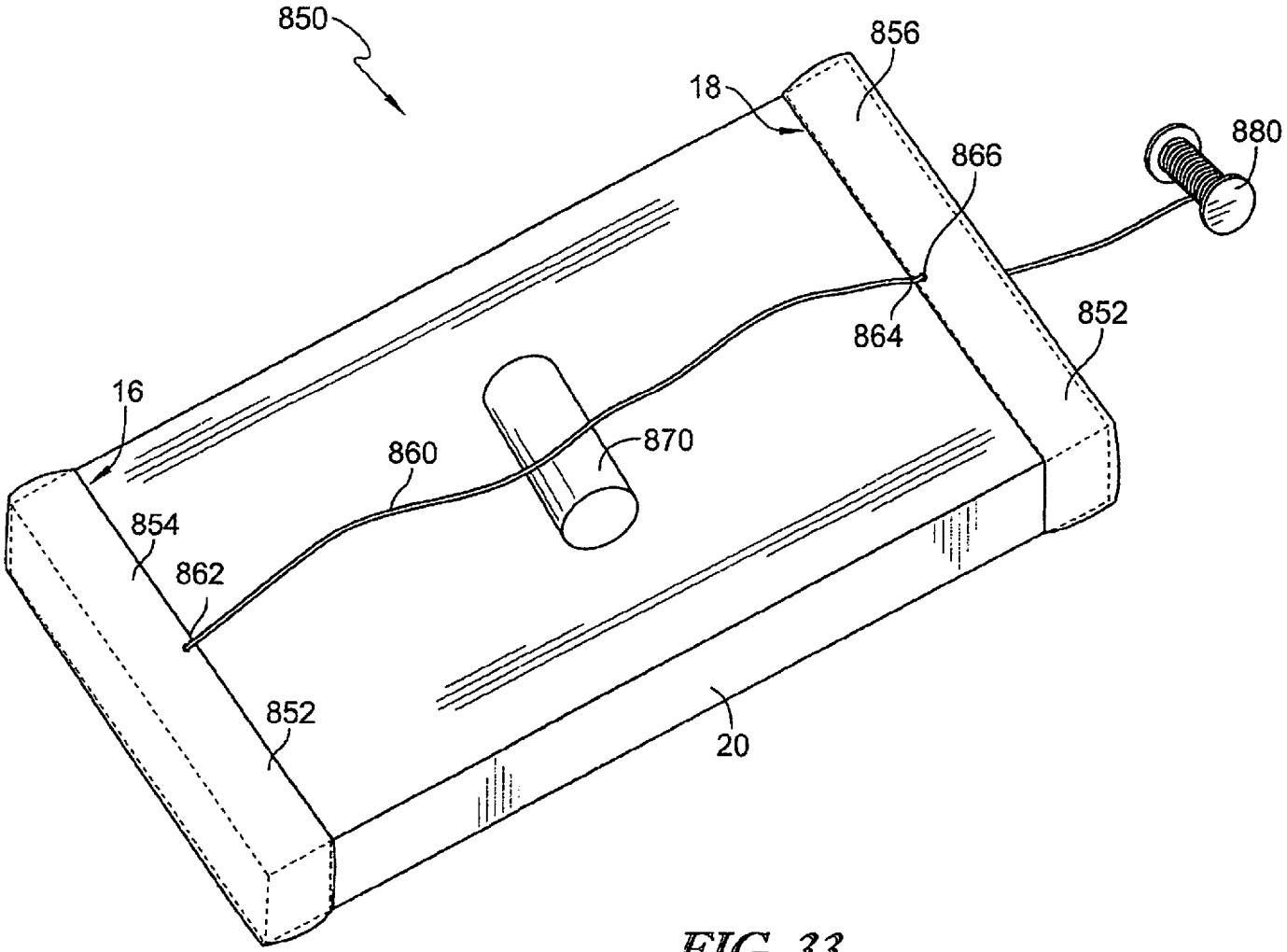
FIG. 33 is a perspective view of a system for positioning a mattress support between a mattress and a box frame.

Referring to FIG. 33 a system 850 is configured to position a mattress support (not shown) between the mattress 20 and the box frame 12. The system 850 includes a pair of sleeves 852 including a head end sleeve 854 and a foot end sleeve 856. The head end sleeve 854 is positioned around the head end 16 of the mattress 20, and the foot end sleeve 856 is positioned around the foot end 18 of the mattress 20. The head end sleeve 854 is coupled and secured to the head end 16 of the mattress 20, the foot end sleeve 856 is coupled and secured to the foot end 18 of the mattress 20.

A cable 860 extends between the head end sleeve 854 and the foot end sleeve 856. A first end 862 of the cable 860 is coupled to the head end sleeve 854, and a second end 864 of the cable 860 extends through an eyelet 866 in the foot end sleeve 856. In some embodiments, the first end 862 of the cable 860 is coupled to the foot end sleeve 856, and the second end 864 of the cable 860 extends through an eyelet in the head end sleeve 854. The cable 860 extends over an anchor 870 positioned on the mattress 20. The anchor 870 provides leverage to the cable 860 so that the cable can lift the head end 16 and the foot end 18 of the mattress 20.

Figure 34:
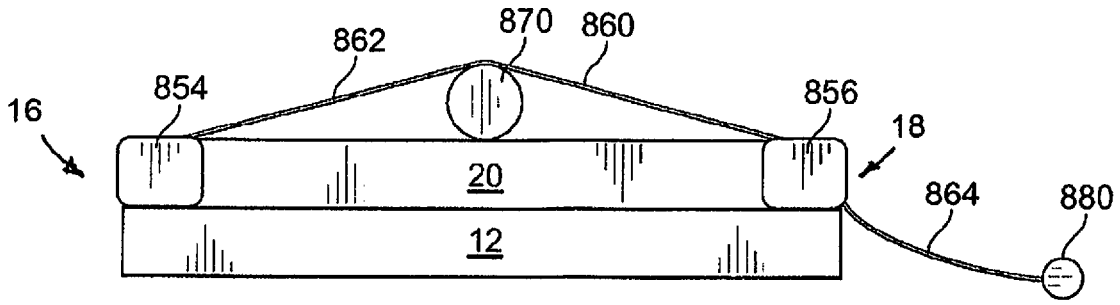
FIG. 34 is a perspective view of the system shown in FIG. 32 and in a lowered position.
Figure 35:
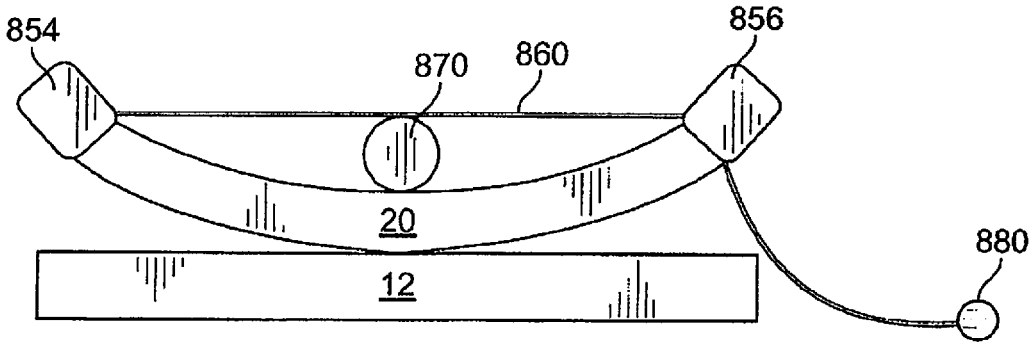
FIG. 35 is a perspective view of the system shown in FIG. 32 and in a raised position.

When the system 850 is initially installed, the head end 16 and the foot end 18 of the mattress 20 are positioned on the frame 12, as illustrated in FIG. 34. The second end 864 of the cable 860 is pulled away from the mattress 20. In some embodiments, the second end 864 of the cable 860 is pulled by a winch 880. The cable 860 is pulled through the eyelet 866 so that the first end 862 of the cable 860 is drawn toward the foot end 18 of the mattress 20. By drawing the cable 860, the cable 860 creates a force on the head sleeve 854 and the foot end sleeve 856 such that the head end sleeve 854 lifts the head end 16 of the mattress 20 and the foot end sleeve 856 lifts the foot end 18 of the mattress 20, as shown in FIG. 35. With the head end 16 of the mattress 20 lifted, a mattress support may be positioned between the head end 16 of the mattress 20 and the box frame 12. When the mattress support is in positioned between the mattress 20 and the box frame 12, the cable 860 is released so that the mattress 20 rests on the mattress support.

Figure 36:
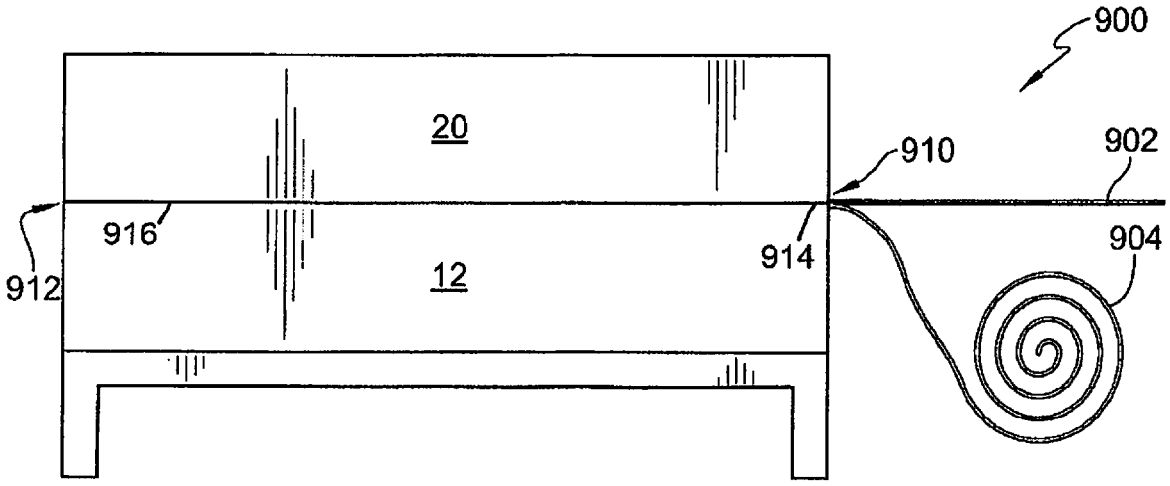
FIG. 36 is a side elevation view of a rod and cable positioned between a mattress and a box frame.

Referring to FIG. 36 a system 900 for positioning a mattress support between the mattress 20 and the box frame 12 includes a rod 902 attached to a cable 904. The rod 902 is fed from a first side 910 of the mattress 20 to a second side 912 of the mattress 20 so that a first end 914 of the cable 904 is positioned on the first side 910 of the mattress 20 and a second end 916 of the cable 904 is positioned on the second side 912 of the mattress 20.

Figure 37:
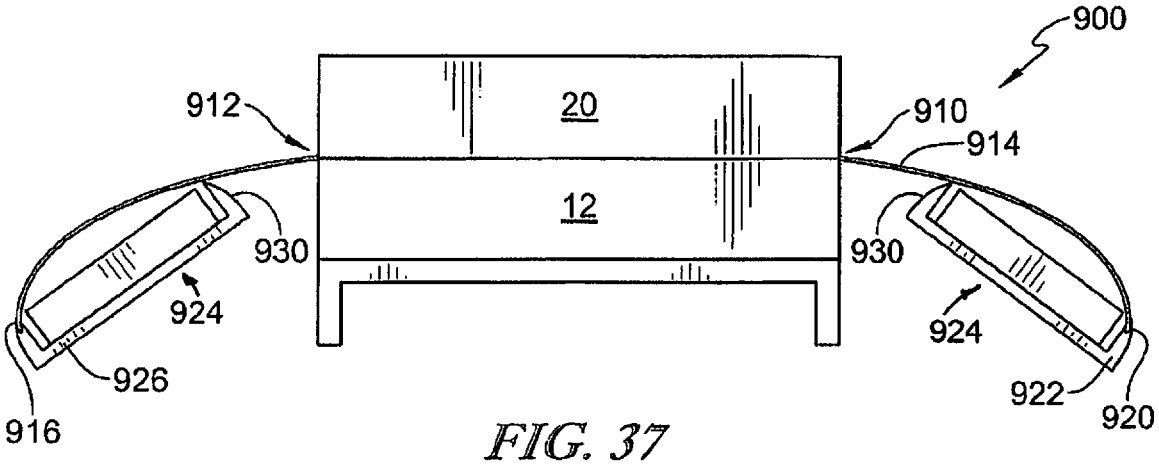
FIG. 37 is a side elevation view of a pair of mattress supports configured to be positioned between a mattress and a box frame.

As illustrated in FIG. 37, the first end 914 of the cable 904 is coupled to a winch 920 on a first half 922 of a mattress support 924. The second end 916 of the cable 904 is coupled and secured to a second half 926 of the mattress support 924.

The first half 922 of the mattress support 924 is positioned on the first side 910 of the mattress 20. The second half 926 of the mattress support 924 is positioned on the second side 912 of the mattress 20. Each of the first half 922 and the second half 926 includes an angled surface 930 that faces the mattress 20. The angled surface 930 facilitates advancing the first half 922 and the second half 926 of the mattress support 924 between the mattress 20 and the box frame 12.

Figure 38:
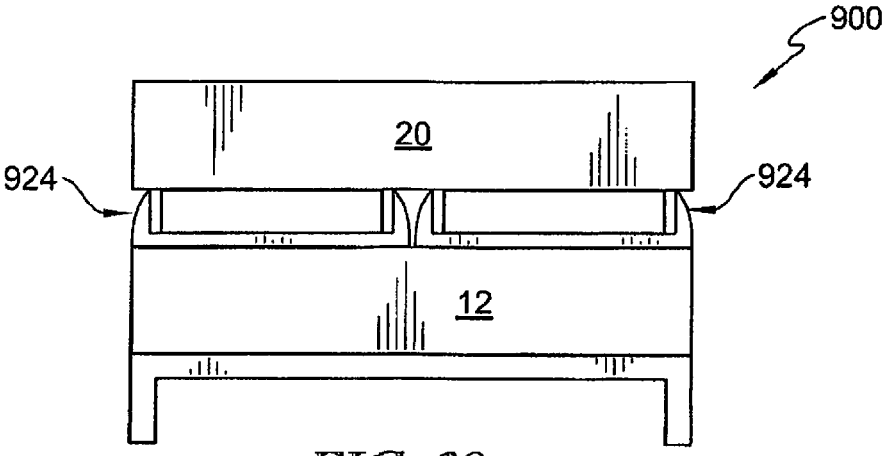
FIG. 38 is a side elevation view of the pair of mattress supports shown in FIG. 36 and positioned between the mattress and the box frame.

The cable 904 is drawn by activating the winch 920 to advance the first half 922 of the mattress support 924 toward the second half 926. Likewise, the second half 926 of the mattress support 924 is advanced toward the first half 922. As the first half 922 and the second half 926 advance, the angled surface 930 facilitates wedging the first half 922 and the second half 926 between the mattress 20 and the box frame 12. The first half 922 and the second half 926 continue to advance until each half 922, 926 is positioned between the mattress 20 and the box frame 12, as illustrated in FIG. 38.

Figure 39:
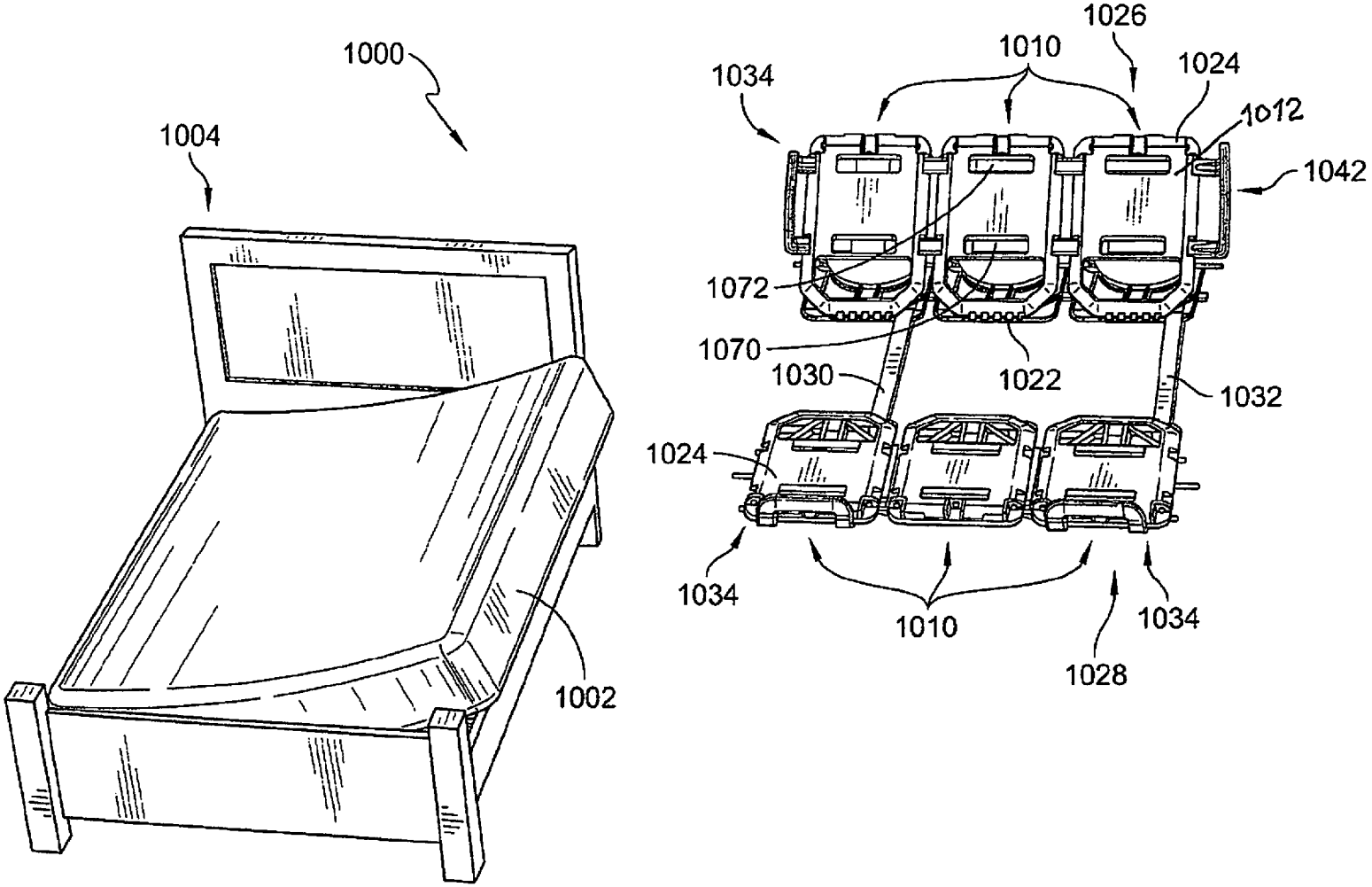
FIG. 39 is a perspective view of another embodiment of a system according to the present disclosure, FIG. 39 showing the entire system adjacent and positioned to be placed under a mattress.
Figure 40:
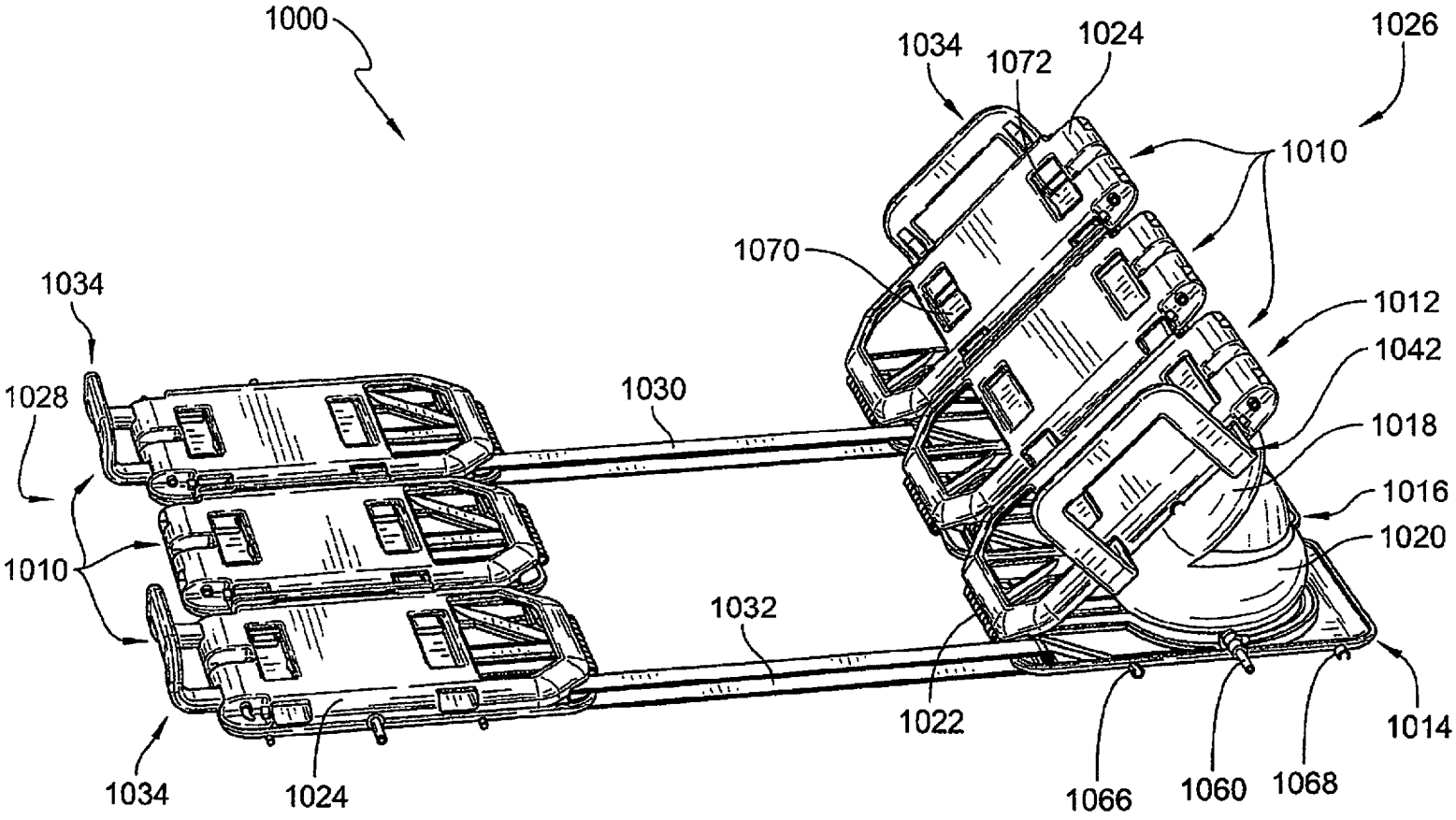
FIG. 40 is a perspective view of the system of FIG. 39.

Referring now to FIGS. 39-48, a system 1000 has multiple modules 1010 that are positionable under a mattress 1002 of a bed 1004. Referring to FIG. 40, each of the modules 1010 comprise an upper plate 1012, a lower plate 1014, and a bladder structure 1016 positioned between the plates 1012, 1014. The bladder structure 1016 comprises an upper bladder 1018 and a lower bladder 1020 that are coupled together to be pneumatically communicative. The plates 1012, 1014 are illustratively located within an outer cover 1024 and hinged together at a hinge point 1022. Notably, the modules 1010 can be used individually, or as a system as shown in FIG. 39. The upper plates 1012 may be connected together, as will be discussed in further detail below to allow the upper plates 1012 of adjacent modules 1010 to be secured together, causing the adjacent modules 1010 to function as a single unitary lift structure.

Referring to FIG. 40, once the adjacent modules 1010 are coupled together, a group 1026 of modules configured to be positioned at the head end of the bed 1004 are tethered to a group 1028 of modules 1010 configured to be positioned at the foot end of the bed 1004 by straps 1030, 1032 to keep the pressure of the mattress 1002 from pushing the groups 1026, 1028 away from each other and out from under the mattress 1002. The straps 1030, 1032 comprise nylon webbing that can be held together and drawn together by a ratcheting mechanism know for ratchet straps of this type.

Figure 41:
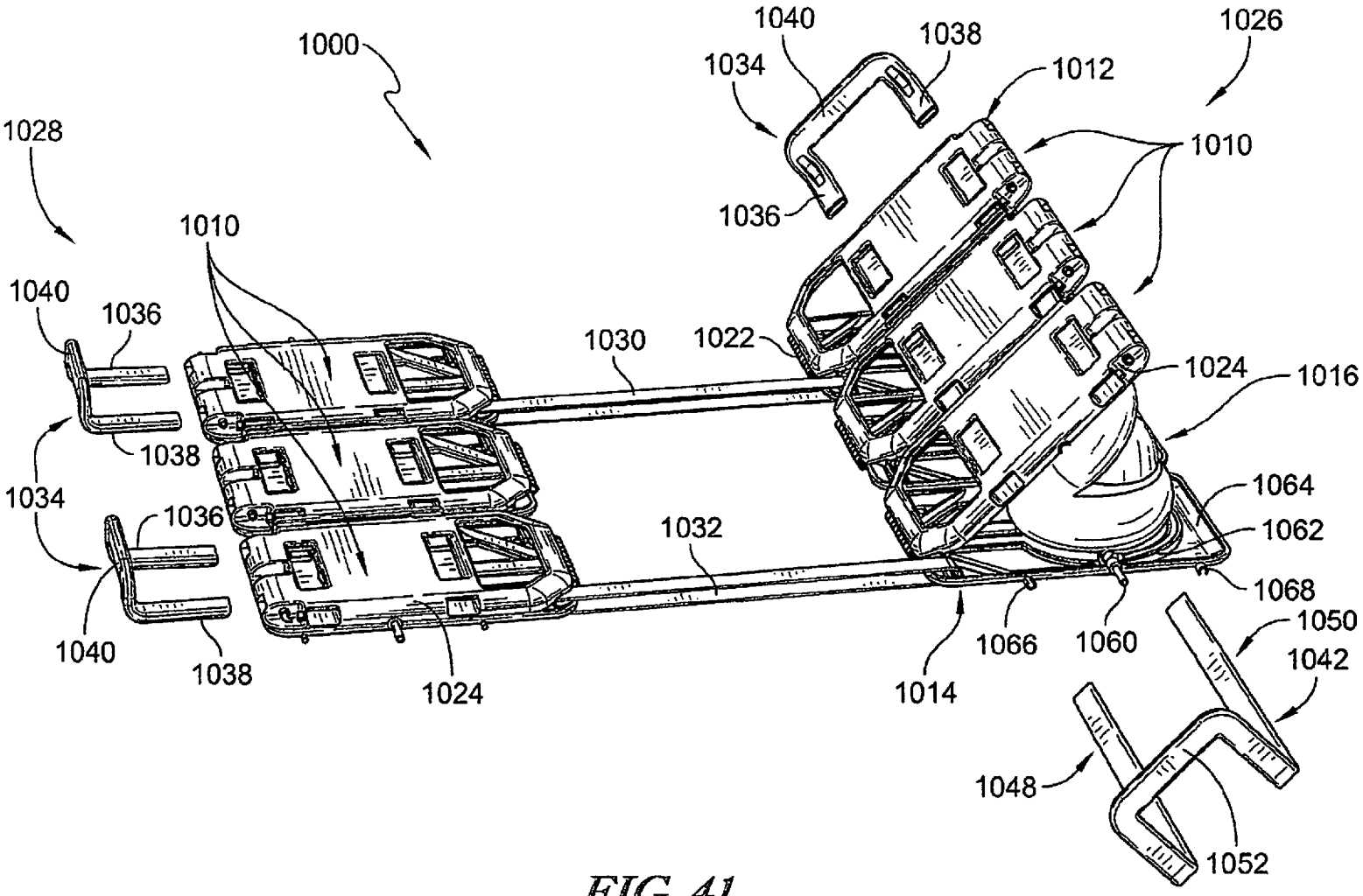
FIG. 41 is a perspective view of the system of FIG. 39 with portions of the system exploded away to show the structure and function.

The upper plates 1012 are configured to be integrated and secured by various modular connectors. In addition, the plates 1012 are configured to support and secure mattress locators 1034 as shown in FIG. 41. The mattress locators 1034 serve as mattress stops at various locations around the system 1000. The mattress locators 1034 each have two legs 1036, 1038 and a body 1040. The legs 1036, 1038 are inserted into receivers in the upper plates 1012 and secured by a ratchet lock 1040 shown in FIG. 42. The body 1040 extends upwardly away from the legs 1036, 1038 and serves to engage the side of the mattress 1002 to maintain the location of the mattress 1002 on the system 1000. The system 1000 may also have a siderail support 1042 that is similar to the mattress locators 1034, but further includes receivers 1044, 1046 (see FIG. 44) that are configured to receive the legs of a siderail and support the siderail relative to the system 1000 when it is in use. The siderail support 1042 includes two legs 1048, 1050 that are received in the upper plate 1012 as indicated in FIG. 41. A body 1052 extends up from the legs 1048, 1050 and provides the receivers 1044, 1046. The body 1052 also rests adjacent the side of the mattress 1002 and helps maintain the location of the mattress 1002 on the system 1000.

FIG. 41 also shows the inlet 1060 for the bladder structures 1016. The bladder structures 1016 are each interconnected by a hose 1062 that is positioned in a trough 1064 formed in the lower plate 1014. The lower plates 1014 also include complementary connectors 1066, 1068 that are configured to engage the opposite connector 1066, 1068 on adjacent lower plates 1014 so that the lower plates 1014 interconnect when the groups 1026, 1028 of modules 1010 are assembled in to the system 1000.

Figure 42:
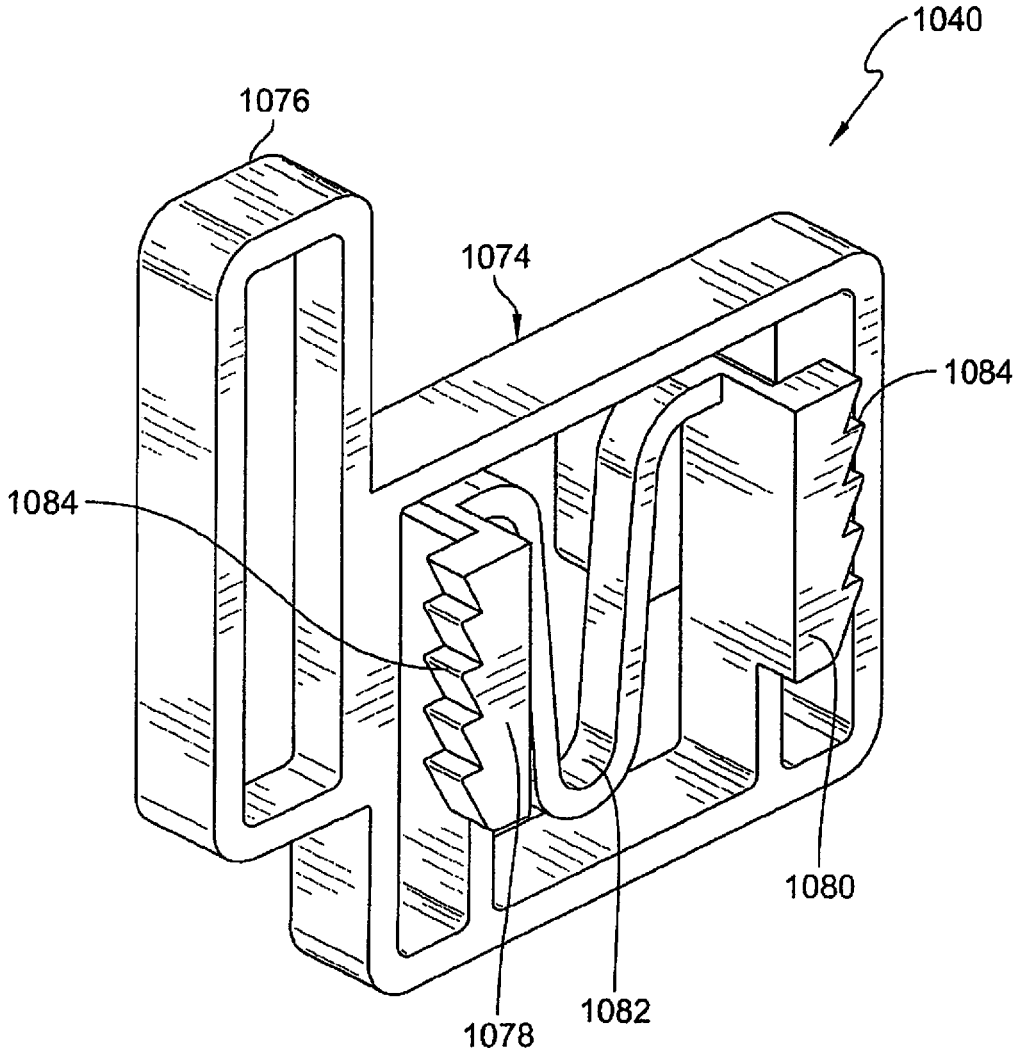
FIG. 42 is a perspective view of a locking structure for the system of FIG. 39.

Referring again to FIG. 39, each plate 1012 has an upper opening 1072 and a lower opening 1070. The ratchet lock 1040 can be positioned in either or both of the openings 1070 and 1072 to secure the respective structures to the plates 1012. Referring to FIG. 42, the ratchet lock 1040 comprises a frame 1074, a stop 1076 secured to the frame 1074, a pair of ratchet wings 1078, 1080, and a release grip 1082. The ratchet wings 1078, 1080 are each formed with ratchet teeth 1084 that are engaged by a complementary set of teeth on the locking structures inserted into the plates, such as the siderail support 1042 or the mattress locators 1034. In addition, there is a connector 1086, shown in FIG. 43, which may be used between two modules 1010.

Figure 43:
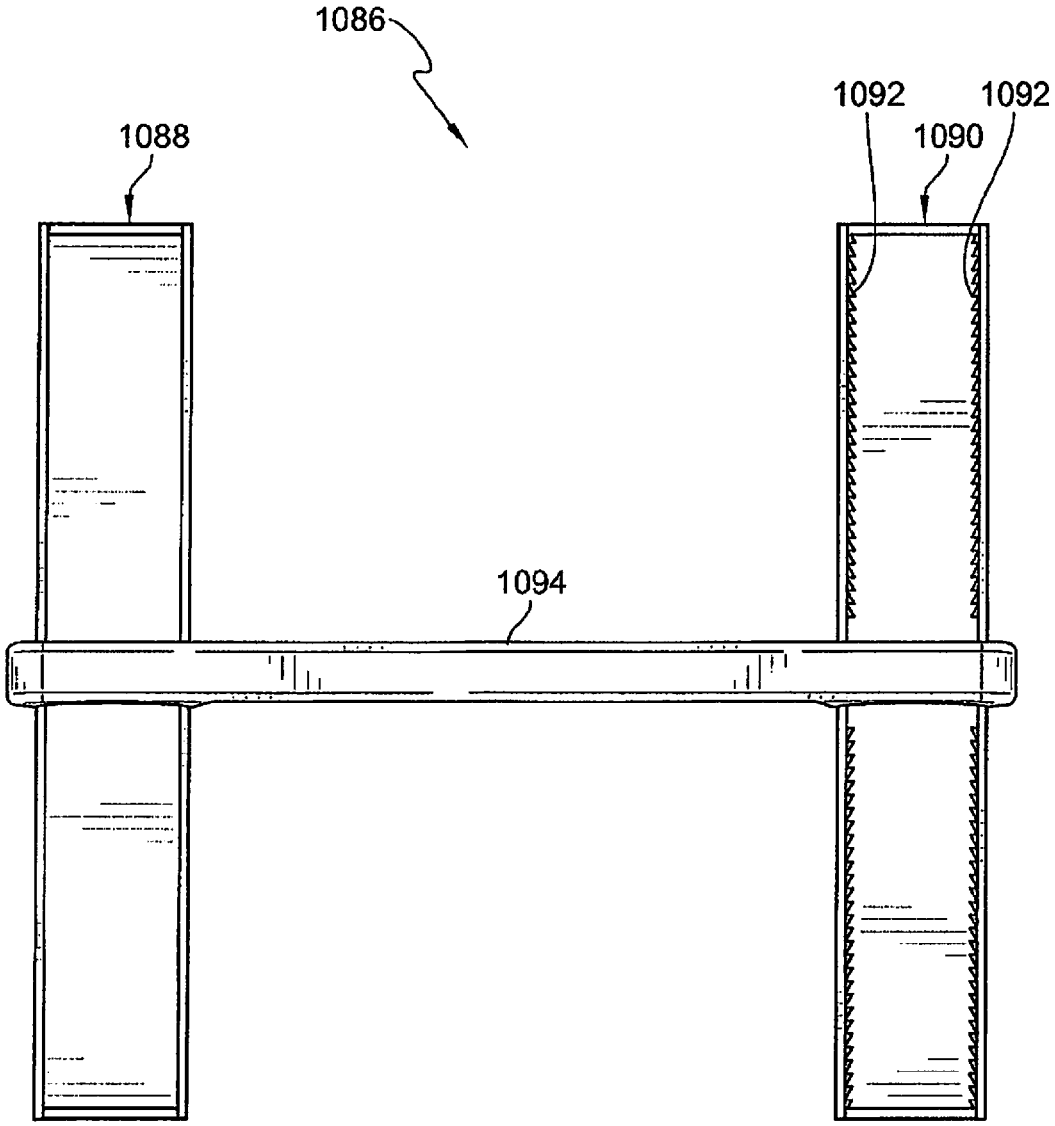
FIG. 43 is a top plan view of a connector of the system of FIG. 39.

The connector 1086 includes two arms 1088, 1090 that are connected by a beam 1094. The arm 1090 is formed to include interior ratchet teeth 1092 which are complementary to the ratchet teeth 1084 of the ratchet lock 1040 as shown in FIGS. 42 and 43. When the connector 1086 is positioned so that the arms 1088, 1090 are inserted into adjacent upper plates 1012 with the beam 1094 positioned between the modules 1010. The ratchet lock 1040 is inserted into the arm 1090 by squeezing the release grip 1082 to pull the ratchet wings 1078, 1080 together. Once the teeth 1084 are narrowed, the ratchet lock 1040 is positioned in the arm 1090 so that the ratchet teeth 1084 of the ratchet lock 1040 engage the ratchet teeth 1092. The stop 1076 engages a portion of the upper plate 1012 so that the ratchet teeth 1084 and 1092 cause the connector 1086 to be secured to the respective plates 1012, 1012 until the release grip 1082 is activated to remove the ratchet lock 1040.

Figure 44:
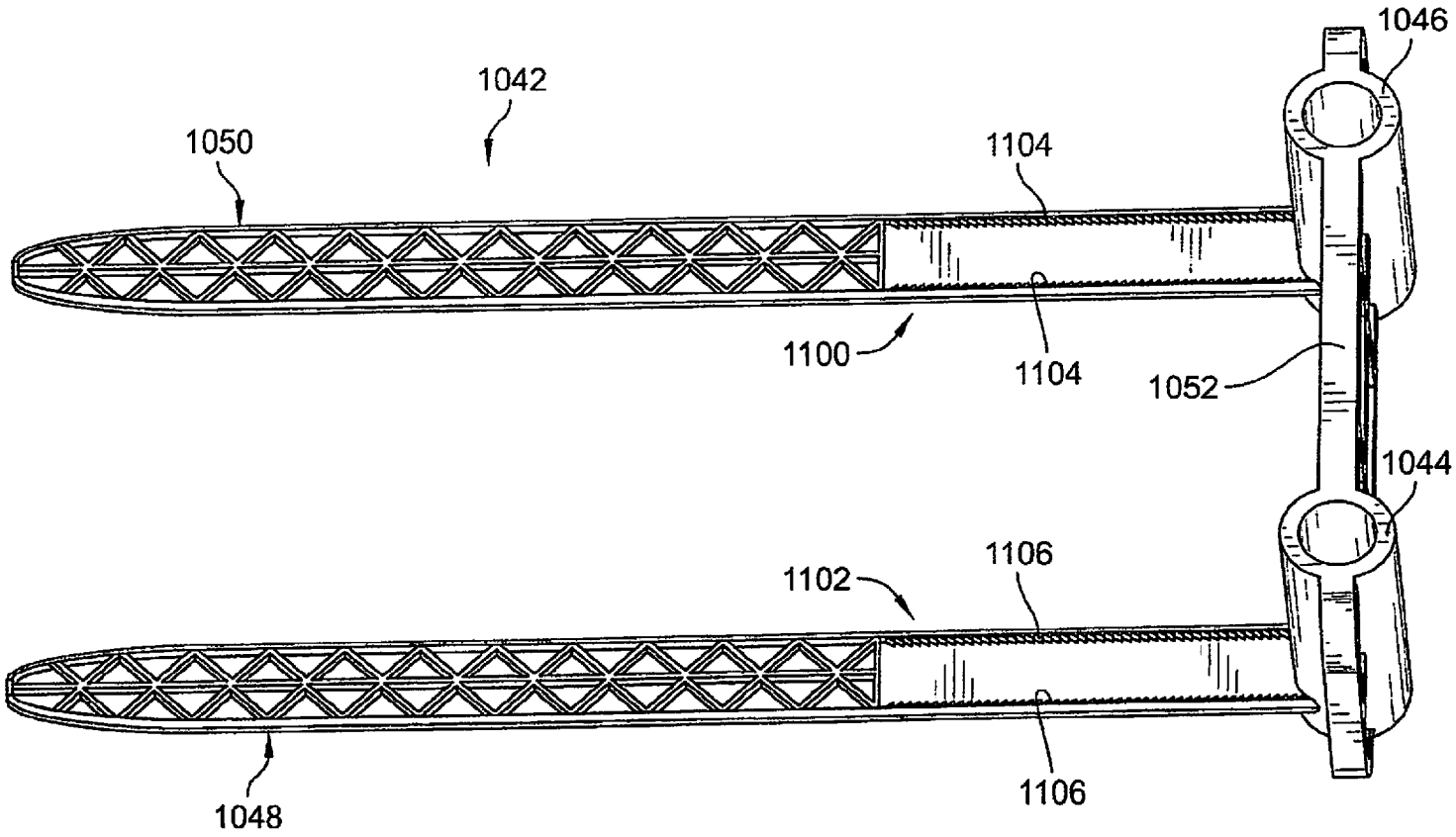
FIG. 44 is a perspective view of a connector of the system of FIG. 39, the connector of FIG. 44 also serving as a siderail support.

Referring now to FIG. 44, it can be seen that the legs 1048, 1050 of the siderail support 1042 each include respective locking sections 1100, 1102 that are formed to include ratchet teeth 1104, 1106. The ratchet teeth 1104, 1106 are engaged by the ratchet lock 1040 in a similar way to that described above with regard to the arm 1090 of the connector 1086. Thus, when the mattress locators 1034, siderail support 1042, and connector 1086 are all connected together and secured with ratchet locks 1040, adjacent modules 1010 cooperate to form a group 1026 or 1028. It should be understood that a particular system can include a single module 1010, a module 1010 connected by a tether 1032 to a module 1010 to form a single wide system 1000, or several modules 1010 can be assembled in an adjacent fashion to form several side-by-side modules 1010 in a group 1026 or 1028, to account for beds 1004 of varying width.

Another embodiment of a mattress support system 1200, similar to the embodiment of the mattress support system 1000 and that can be used in the same way that the modules of the system 1000 or the structures of system 40, is described is shown in FIGS. 45-48. The system 1200 is formed by coupling the plurality of modules 1210 as shown in FIGS. 45-48. Illustratively, the system 1200 is formed by a pair of outer modules 1326 spaced apart from and coupled to an at least one middle module 1328 positioned therebetween. It should be appreciated that any number of middle modules 1328 may be positioned between the pair of outer modules 1326. Such coupling may be accomplished using the upper plates 1222 of the modules 1210. Illustratively, the upper plates 1222 are coupled to one other and further coupled to an outer cover 1024 extending around each of the modules 1210 similar to the discussion of the outer cover 1024 with regard to the system 1000 above.

The upper plate 1222 is formed to include an upper edge 1310 and a body 1314 defining a pair of side edges 1316 of each of the modules 1210. The upper plate 1222 is further formed to include an at least one bracket 1254 configured to receive an at least one coupler extension 1256 therein. As shown in FIGS. 45-48, each of the upper plates 1222 may be formed to include a varied number of brackets 1254. Illustratively, depending on the location of the module 1210, the brackets 1254 coupled to the upper plate 1222 of one of the modules 1210 may be positioned/laid out differently than the brackets 1254 of a different module 1210 of the system 1200. It should be appreciated that the brackets 1254 may also be positioned similarly in each of the modules 1210. The brackets 1254 and the coupler extension 1256 cooperate to couple the modules 1210 to one another. The modules 1210 include bladder structures 1216 having bladders 1018 and 1020, similar to the bladder structure 1016 described above. The bladder structures 1216 function similarly to the bladder structures 1016 and are pneumatically interconnected in the same way as described with reference to the system 1000. As such, upon inflation of at least one of the bladder structures 1216, the upper plates 1222 are formed to move together such that each module 1210 moves substantially similar to the modules 1010 forming the system 1000. However, the module 1210 does not include a hinge, but a bracket 1312 of a lower plate 1313 is positioned to engage the lower edge 1315 of the upper plate 1222. In this way, the upper plate 1222 is independent of the lower plate 1313 and the lower plate 1313, bladder structure 1216, and upper plate 1222 can be assembled together at the bed and do not have to be managed as a single unit. This eliminates the need for a user to support the weight of all of the components when installing the system 1200. The bracket 1312 prevents the upper plate 1222 from sliding relative to the lower plate 1313 and thereby provides a pivot point for the upper plate 1222 relative to the lower plate 1313.

Illustratively, each of the modules 1210 includes an at least one bracket 1254 embodied as a pair of upper brackets 1318 positioned near the upper edge 1310 of the upper plate 1222, a pair of middle brackets 1320 spaced apart therefrom, and a pair of lower brackets 1322 positioned near the lower edge 1312 of the upper plate 1214. It should be appreciated that the at least one bracket 1254 may be embodied as any number of brackets and the positioning of such brackets 1254 may be varied. The brackets 1254 may be formed substantially similar to those configured to receive a coupler extension 1256 such that the brackets 1254 may receive any one of a coupler extension 1256, a siderail support 1242, and/or a mattress locator 1234.

The pair of outer modules 1326 are formed to further include a single bracket 1324 coupled thereto. Illustratively, the single bracket 1324 is spaced apart from and located between the middle brackets 1320 and the lower brackets 1322. The single bracket 1324 is further located such that it is positioned at the side edge 1316 nearest the middle module 1328 coupled thereto. The outer modules 1326 are further formed to receive the siderail support 1242 and/or the mattress locator 1234 within the pair of middle brackets 1320. Illustratively, only one of the outer modules 1326 of the group of modules 1226 positioned at the head end of the bed 1204 is coupled to the siderail support 1242 and the remaining outer module 1326 is coupled to the mattress locator 1234. Further, both of the outer modules 1326 of the group of modules 1228 positioned at the foot end of the bed 1204 are coupled to a pair of mattress locators 1234, illustratively. It should be appreciated that any combination of mattress locaters 1234 and siderail supports 1242 may be coupled to either group of modules 1226, 1228.

The middle module 1328 includes an additional pair of brackets 1330 positioned between the middle brackets 1320 and the lower brackets 1322 and horizontally aligned with the single bracket 1324 of the pair of outer modules 1326. Illustratively, the single bracket 1324 of the outer modules 1326 and the additional pair of brackets 1330 of the middle module 1328 cooperate such that one of the additional pair of brackets 1330 and a single bracket 1324 of one of the outer modules 1326 receive a shared coupler extension 1256 therein.

As such, the brackets 1254 are coupled to the upper plates 1214. Further, the brackets 1254, the upper plates 1214, and the outer covers 1024 are formed into include a plurality of apertures 1238 therein and extending therethrough. The plurality of apertures 1238 of the brackets 1254 are formed to align with the plurality of apertures 1238 formed in the upper plates 1214 and the outer cover 1024 such that a coupling mechanism (not shown) may be positioned therein. Illustratively, such coupling mechanisms are formed as a pin sized to extend through the upper plate 1214, the bracket 1254, and the outer cover 1024 such that the three aforementioned elements 1214, 1254, and 1024 are coupled together.

Figure 45:
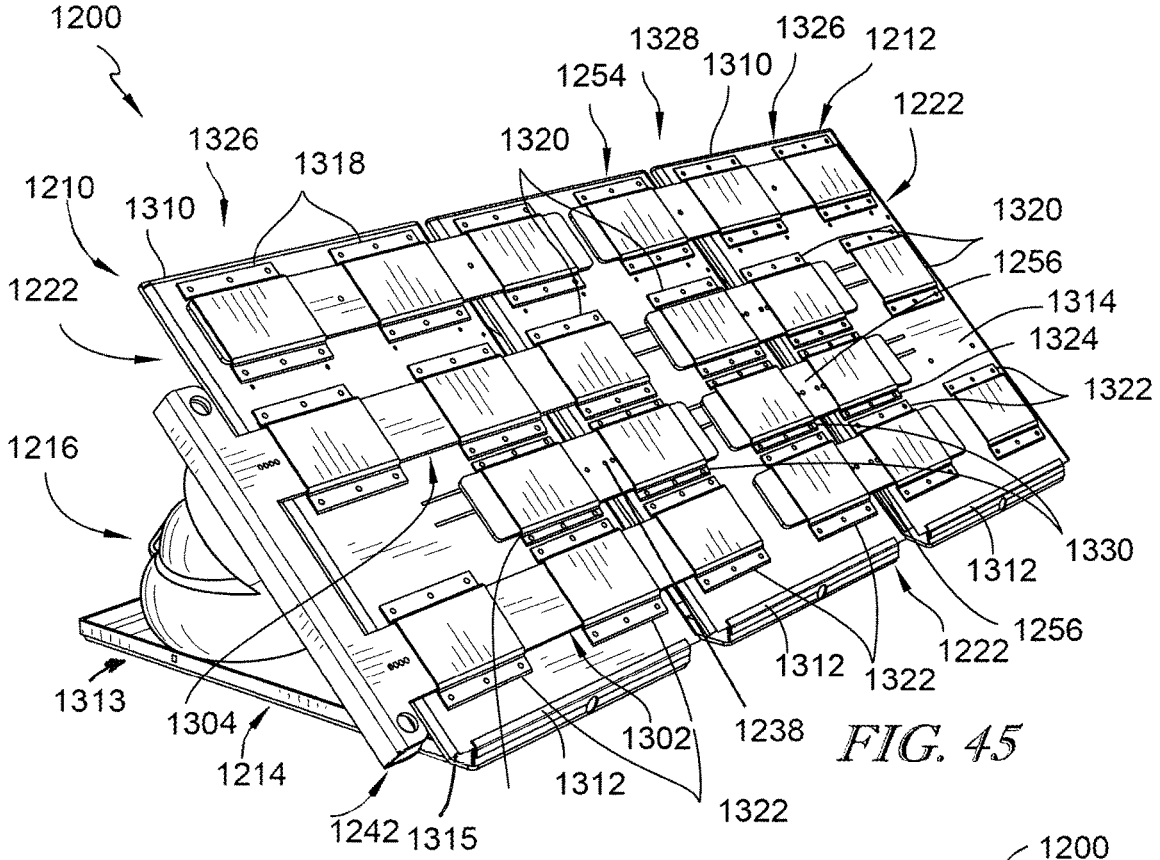
FIG. 45 is a perspective view of a structure similar to the structure of FIG. 39.
Figure 46:
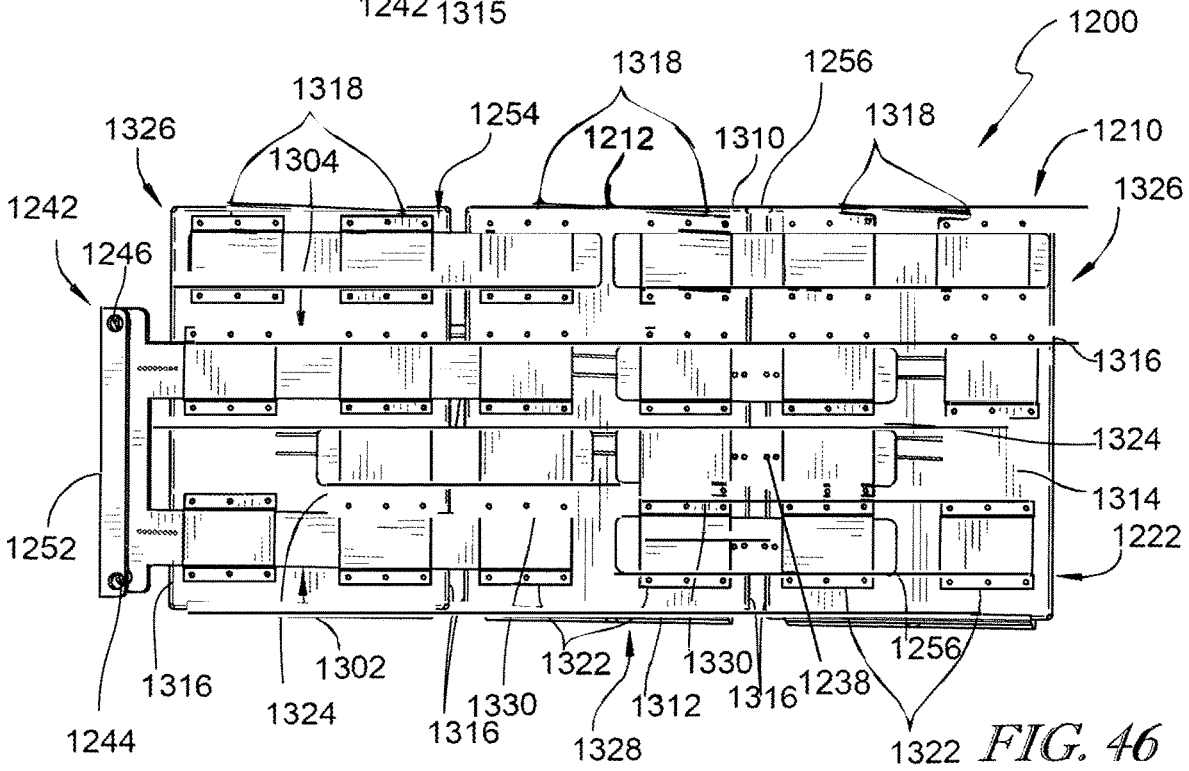
FIG. 46 is a top plan view of the structure of FIG. 45.

As shown in FIGS. 45 and 46, in one coupling embodiment, the outer modules 1326 are coupled to the middle module 1328 at each of the brackets 1318, 1320, 1322, 1324, 1330. Illustratively, a single coupler extension 1256 extends between the upper brackets 1318 of one of the outer modules 1326 and one of the pair of upper brackets 1318 of the middle module 1328. Such configuration of the outer module 1326 is replicated with the remaining outer module 1326 such that a second coupler extension 1256 extends between the upper brackets 1318 of the remaining outer module 1326 and the remaining one of the pair of upper brackets 1318 of the middle module 1328. Illustratively, either outer module 1326 may be configured to couple to a siderail support 1242 or a mattress locator 1234. As such, the middle brackets 1320 of either outer module 1326 cooperate with the one of the pair of middle brackets 1320 of the middle module 1328 nearest to the outer module 1326 to receive a first portion of the siderail support 1242 or a mattress locator 1234 therein. Further, the lower brackets 1322 of either outer module 1326 cooperate with the one of the pair of lower brackets 1322 of the middle module 1328 nearest to the outer module 1326 to receive a second portion of the siderail support 1242 or the mattress locator 1234 therein. The outer module 1326 not coupled to the siderail support 1242 or mattress locator 1234 is configured to couple to the middle module 1328 at one of the pair of middle brackets 1320 of each module 1326, 1328, the single bracket 1324 of the outer module 1326 and one of the additional pair of brackets 1330 of the middle module 1328, and one of the pair of lower brackets 1322 of each module 1326, 1328. It should be understood that a differing number of coupler extensions 1256 may be used to couple the modules 1210 than that disclosed herein. Further, the placement of the brackets 1254 may be varied while still accomplishing the same goal of coupling.

Figure 47:
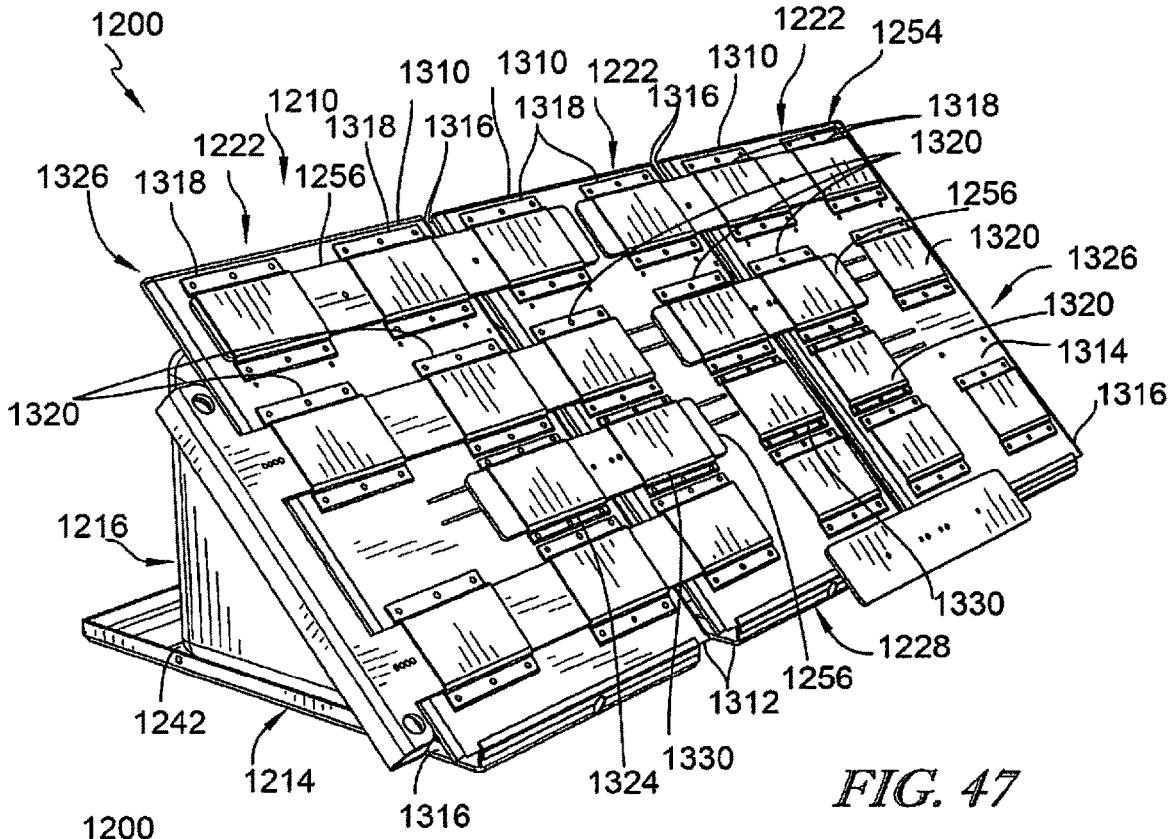
FIG. 47 is a perspective view of the structure of FIG. 45.
Figure 48:
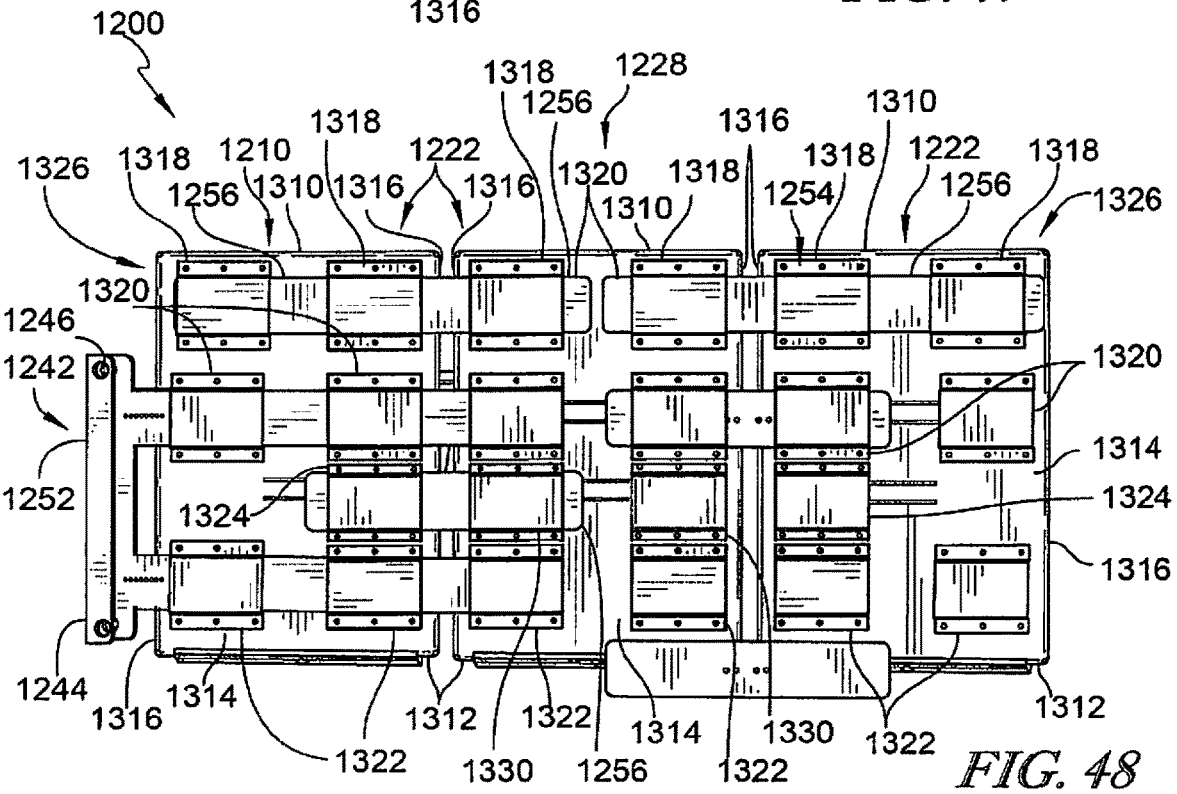
FIG. 48 is a perspective view of the system of FIG. 47.

Turning to FIGS. 47 and 48, in another coupling embodiment, the brackets 1254 of the outer modules 1326 and middle module 1328 are substantially similar to that as described in the embodiment shown in FIGS. 45 and 46. As such, the aforementioned disclosure concerning FIGS. 45 and 46 applies to FIGS. 47 and 48 but for where distinctions are made between the two embodiments. One such distinction is the coupling of one of the outer modules 1326 to the middle module 1328 at the lower brackets 1322 and at one of the additional brackets 1330 and the single bracket 1324. Illustratively, the outer module 1326 not coupled to the siderail support 1242 and/or the mattress locator 1234 is uncoupled from the middle module 1328 at the aforementioned brackets 1322, 1330, 1324. As shown in FIGS. 47 and 48, the brackets 1322, 1330, 1324 do not engage a coupler extension 1256 therein. Rather, an outer bracket 1332 is coupled to the lower edge 1312 of the upper plates 1212 of the middle module 1228 and one of the outer modules 1226.

The outer bracket 1332 is formed to include a top edge 1334, a bottom edge 1336 spaced apart therefrom, a body 1336 extending therebetween and thereby defining a pair of side edges 1338. Illustratively, the top edge 1334 and a portion of the body 1338 of the outer bracket 1332 are coupled to the middle module 1228 and outer module 1226 and configure the two modules 1226, 1228 to move simultaneously in response to the air bladder 1216. The bottom edge 1336 remains uncoupled from the modules 1210, illustratively.

The brackets 1254 of FIGS. 47 and 48 are formed to include a plurality of apertures 1238 and are coupled to the upper plates 1214 and outer covers 1024 as described above concerning FIGS. 45 and 46 using a coupling mechanism. Further, the outer bracket 1332 is coupled to the upper plates 1214 and outer covers 1024 of the middle module 1228 and one of the outer modules 1226 in substantially the same manner as the other brackets 1254 coupled to the upper plates 1214 of the modules 1210. Illustratively, the outer bracket 1332 is configured to function substantially similar to the coupler extensions 1256 extending through the lower brackets 1322 and additional bracket 1330 and single bracket 1324 coupling the at least one outer module 1226 and the middle module 1228 as shown in FIGS. 45 and 46.

Although this disclosure refers to specific embodiments, it will be understood by those skilled in the art that various changes in form and detail may be made without departing from the subject matter set forth in the accompanying claims.

The invention claimed is:

1. A mattress support system comprising:

a first group including a first module and a second module configured to be coupled to the first module, each of the first module and the second module being configured to be positioned under a mattress and each of the first module and second module including:

a lower plate configured to be positioned on frame of a bed, a upper plate supported on the lower plate to permit the upper plate to pivot relative to the lower plate at a pivot point, a bladder structure positioned between the lower plate and the upper plate and inflatable to pivot the top plate about the pivot point, wherein the upper plate of each of the first module and the second module includes brackets positioned on an upper surface of the respective upper plate, at least one coupler extension that is positioned in at least one bracket of a first module and in at least one bracket of second module to interengage the two modules, a hose directly connected to the bladder structure of the first module and directly connected to the bladder structure of the second module, and providing direct communication of fluid between the bladder structures of the first and the second modules.

2. The mattress support system of claim 1, wherein the mattress support system further comprises a fluid pump to provide fluid to the bladders structures to inflate the bladder structures and pivot the upper plates about the respective pivot points.

3. The mattress support system of claim 2, wherein the bladder structures include respective upper bladders and respective lower bladders, the upper bladder and lower bladder of each bladder structure being pneumatically communicative.

4. The mattress support system of claim 2, wherein the interengagement of the modules by the at least one coupler extensions causes the upper plates of each of the first and second modules to move together about their respective pivot points.

5. The mattress support system of claim 4, wherein the coupler extension includes a plurality of apertures.

6. The mattress support system of claim 5, wherein the apertures are positioned to receive pins that are supported on the coupler extension and configured to engage a bracket to prevent movement of the coupler extension relative to the bracket when the coupler extension is positioned in the bracket.

7. The mattress of support system of claim 2, wherein the mattress support system includes at least one mattress locator secured to one of the first and second modules.

8. The mattress support system of claim 7, wherein the mattress locator is secured by a bracket on an upper surface of an upper plate of at least one of the first or second module.

9. The mattress support system of claim 8, wherein the support system includes at least one siderail support secured to one of the first and second modules.

10. The mattress support system of claim 9, wherein the siderail support includes a structure that secures first and second modules together.

11. The mattress support system of claim 10, wherein the siderail support includes receivers for receiving legs of a siderail.

12. The mattress support system of claim 2, wherein the lower plate includes a bracket and when the bladders structure is inflated, a lower edge of the upper plate engages the bracket to define the pivot point about which the upper plate pivots, the bracket restraining movement of the upper plate relative to the lower plate.

13. The mattress support system of claim 1, wherein the lower plate includes a bracket and when the bladders structure is inflated, a lower edge of the upper plate engages the bracket to define the pivot point about which the upper plate pivots, the bracket restraining movement of the upper plate relative to the lower plate.

14. The mattress support system of claim 13, wherein the bladder structures include respective upper bladders and respective lower bladders, the upper bladder and lower bladder of each bladder structure being pneumatically communicative.

15. The mattress support system of claim 13, wherein the interengagement of the modules by the at least one coupler extensions causes the upper plates of each of the first and second modules to move together about their respective pivot points.

16. The mattress support system of claim 15, wherein the coupler extension includes a plurality of apertures.

17. The mattress support system of claim 16, wherein the apertures are positioned to receive pins that are supported on the coupler extension and configured to engage a bracket to prevent movement of the coupler extension relative to the bracket when the coupler extension is positioned in the bracket.

18. The mattress of support system of claim 13, wherein the mattress support system includes at least one mattress locator secured to one of the first and second modules.

19. The mattress support system of claim 18, wherein the mattress locator is secured by a bracket on an upper surface of an upper plate of at least one of the first or second module.

20. The mattress support system of claim 19, wherein the support system includes at least one siderail support secured to one of the first and second modules.

21. The mattress support system of claim 20, wherein the siderail support includes a structure that secures first and second modules together.

22. The mattress support system of claim 21, wherein the siderail support includes receivers for receiving legs of a siderail.

23. The mattress support system of claim 22, wherein the lower plate includes a bracket and when the bladders structure is inflated, a lower edge of the upper plate engages the bracket to define the pivot point about which the upper plate pivots, the bracket restraining movement of the upper plate relative to the lower plate.

* * * * *